US007927775B2

(12) United States Patent
Komatsu et al.

(10) Patent No.: US 7,927,775 B2
(45) Date of Patent: Apr. 19, 2011

(54) MAGNETIC CARRIER AND TWO COMPONENT DEVELOPER

(75) Inventors: Nozomu Komatsu, Mishima (JP); Koh Ishigami, Mishima (JP); Hiroyuki Fujikawa, Yokohama (JP); Kunihiko Nakamura, Gotemba (JP); Chika Inoue, Berlin (DE); Yoshinobu Baba, Yokohama (JP); Takayuki Itakura, Mishima (JP); Tomoko Endo, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/691,057

(22) Filed: Jan. 21, 2010

(65) Prior Publication Data

US 2010/0119968 A1 May 13, 2010

Related U.S. Application Data

(63) Continuation of application No. PCT/JP2009/064092, filed on Aug. 4, 2009.

(30) Foreign Application Priority Data

Aug. 4, 2008 (JP) ..... 2008-200644

(51) Int. Cl.
*G03G 9/00* (2006.01)

(52) U.S. Cl. ..... 430/111.3; 430/111.35; 430/111.4

(58) Field of Classification Search ..... 430/111.3, 430/111.35, 111.4
See application file for complete search history.

(56) References Cited

U.S. PATENT DOCUMENTS

| | | | | |
|---|---|---|---|---|
| 6,010,811 | A | 1/2000 | Baba et al. | 430/106.6 |
| 6,159,648 | A | 12/2000 | Baba et al. | 430/106.6 |
| 6,653,036 | B1 | 11/2003 | Tanikawa et al. | 430/106.2 |
| 2006/0269862 | A1 | 11/2006 | Kobayashi et al. | 430/111.31 |
| 2007/0048649 | A1 | 3/2007 | Kobayashi et al. | 430/111.31 |

FOREIGN PATENT DOCUMENTS

| | | |
|---|---|---|
| JP | 08-050377 | 2/1996 |
| JP | 08-160673 | 6/1996 |
| JP | 8-254857 | * 10/1996 |
| JP | 2006-337579 | 12/2006 |
| JP | 2007-057943 | 3/2007 |
| JP | 4001606 | 10/2007 |

OTHER PUBLICATIONS

International Search Report issued in the corresponding International Application No. PCT/JP2009/064092 dated Nov. 2, 2009 (10 pages).

* cited by examiner

*Primary Examiner* — Mark A Chapman
(74) *Attorney, Agent, or Firm* — Fitzpatrick, Cella, Harper & Scinto

(57) ABSTRACT

Provided is a magnetic carrier giving a high quality image free of density variation without the occurrence of fogging or carrier adhesion and having excellent dot reproducibility even during long-term use. The magnetic carrier has magnetic carrier particles produced by filling pores of porous magnetic core particles with a resin. The magnetic carrier contains 80% by number or more of the magnetic carrier particles satisfying the specific conditions (a) and (b) when 18 straight lines passing through a reference point of a cross section of the magnetic carrier particle are drawn at intervals of 10° in a reflected electron image of the cross section of the magnetic carrier particle photographed by a scanning electron microscope.

5 Claims, 5 Drawing Sheets

MAGNETIC CARRIER AND TWO COMPONENT DEVELOPER

This application is a continuation of International Application No. PCT/JP2009/064092, filed on Aug. 4, 2009, which claims the benefit of Japanese Patent Application No. 2008-200644 filed on Aug. 4, 2008.

BACKGROUND OF THE INVENTION

1. Field of the Invention

The present invention relates to a magnetic carrier and a two component developer used for an electrophotographic method, an electrostatic recording method, and an electrostatic printing method.

2. Description of the Related Art

For example, a ferrite carrier containing a heavy metal has conventionally been used as a carrier. However, such a carrier has a high density and further a large saturated magnetization, and thus a magnetic brush becomes so stiff that deterioration of a developer, such as carrier spent and deterioration of an external additive for toner, can take place easily.

Accordingly, in order to lower specific gravity, a carrier having a surface having very small asperities and an inner structure having many fine voids is proposed (refer to Japanese Patent Application Laid-Open No. H08-050377). The above-mentioned carrier maintains the chargeability because a carrier surface is always ground down in a development unit thereby exposing a newly formed surface. However, the thus ground down carriers increase in the developer during long-term use thereby decreasing the fluidity of the developer and this, in turn, causes image density variation (a decrease in image uniformity) and fogging in some cases.

A resin-filled ferrite carrier produced by filling voids of the ferrite having a porosity of 10 to 60% and an intercommunicating porosity of 1.8 to 4.0 with a resin is proposed (refer to Japanese Patent Application Laid-Open No. 2006-337579). Although the above-mentioned carrier has a lower specific gravity, a higher durability is obtained by controlling a void structure. However, a local difference in the charged electric amount occurs on a carrier surface after toner development, thereby causing a density variation and lowering a dot reproducibility in some cases, and thus there has been room for improvement in such a carrier.

Accordingly, a carrier having a sterically laminated structure in which a resin layer and a ferrite layer are present alternately is proposed (refer to Japanese Patent Application Laid-Open No. 2007-057943). The above-mentioned carrier has a stable chargeability by properties like a capacitor. However, the laminated structure is so dense that filling the void part present near to the center of a core material with a resin is prone to be insufficient. As a result, there has been a case that part of the magnetic carrier was destroyed during long-term durability use, leading to carrier adhesion. Furthermore, the carrier is excessively charged due to the presence of voids, and thus the need still exists to obtain a high quality image stably.

SUMMARY OF THE INVENTION

An object of the present invention is to provide a magnetic carrier and a two component developer which are free from the problems as mentioned above. Specifically, an object of the present invention is to provide a magnetic carrier and a two component developer giving a high quality image free of density variation without the occurrence of fogging or carrier adhesion and having excellent dot reproducibility even during long-term use.

The present invention relates to a magnetic carrier having magnetic carrier particles produced by filling pores of porous magnetic core particles with a resin, characterized in that the magnetic carrier contains 80% or more by number of the magnetic carrier particles satisfying the following (a) and (b) when 18 straight lines passing through a reference point of a cross section of the magnetic carrier particle are drawn at intervals of 10° in a reflected electron image of a cross section of the magnetic carrier particle photographed by a scanning electron microscope; (a) the number of magnetic core regions having a length of 6.0 μm or longer on the straight lines is from 5.0 to 35.0% by number (inclusive) relative to the number of magnetic core regions having a length of 0.1 μm or longer on the straight lines, and (b) the number of regions other than the magnetic core part having a length of 4.0 μm or longer on the straight lines is from 1.0 to 15.0% by number (inclusive) relative to the number of regions other than the magnetic core part having a length of 0.1 μm or longer on the straight lines.

Further, the present invention relates to a two component developer containing a magnetic carrier and a toner, characterized in that the magnetic carrier is the magnetic carrier mentioned above.

By using the magnetic carrier of the present invention, a highly precise and fine image can be formed stably. Specifically, a high quality image free of density variation without the occurrence of fogging or carrier adhesion and having excellent dot reproducibility even during long-term use can be obtained.

Further features of the present invention will become apparent from the following description of exemplary embodiments with reference to the attached drawings.

DESCRIPTION OF THE EMBODIMENTS

Figure 1:
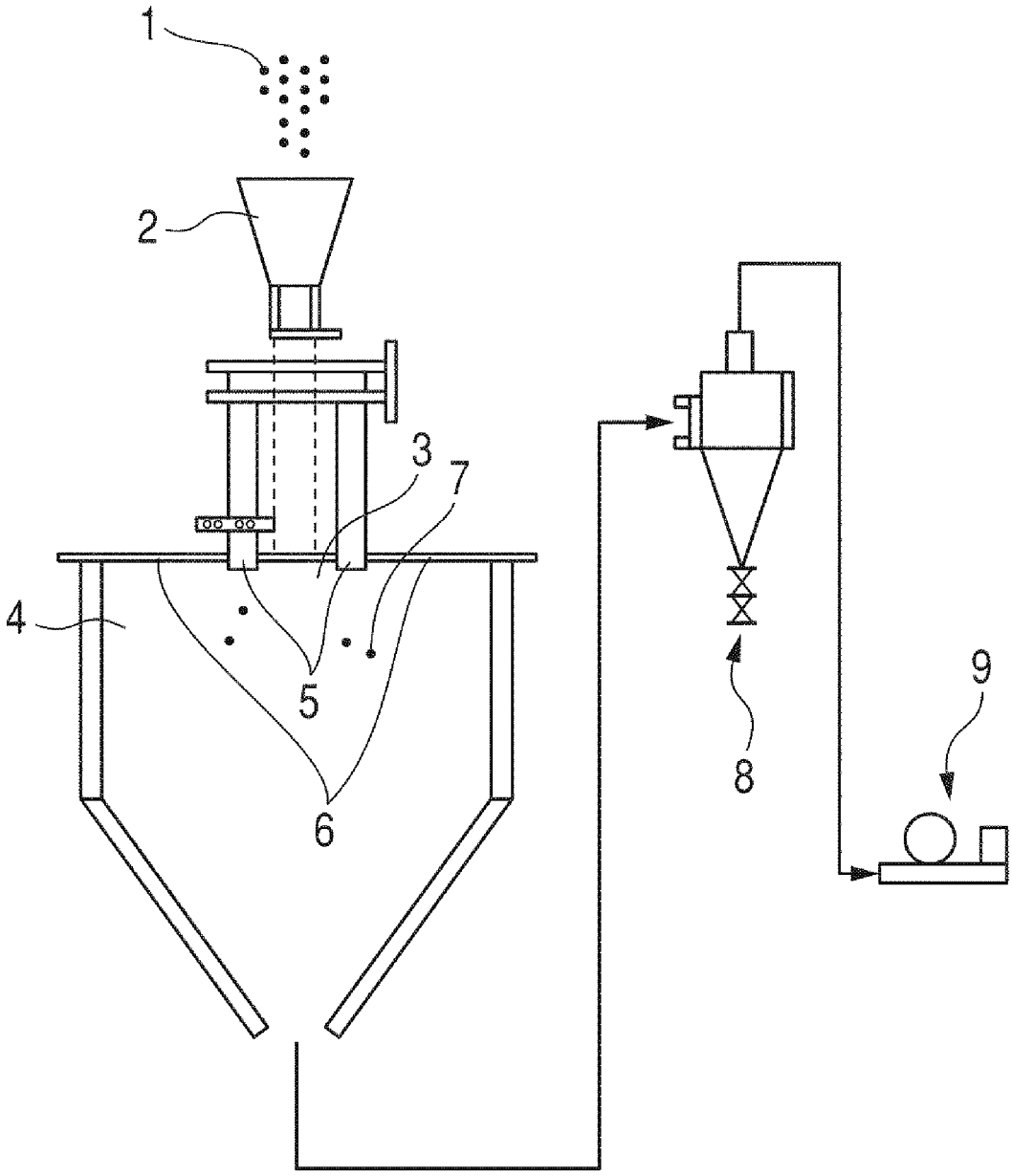
FIG. 1 is a schematic view of a surface modifying apparatus.

When a toner is developed, a counter electric charge having a polarity opposite to that of the toner remains inside a magnetic carrier. This part having a built-up counter electric charge has a high adhesion strength with the toner, which will not leave from the magnetic carrier particles readily. Accordingly, the charging sites on a surface of the magnetic carrier particles decrease, resulting in a large decrease in chargeability as the magnetic carrier. In addition, the toner developed on an electrostatic image carrier is pulled back to a developer carrier by the counter electric charge, resulting in deterioration of the developing properties of the toner.

In order to prevent this phenomenon, the counter electric charge of the magnetic carrier needs to be drained to the developer carrier smoothly through the magnetic carrier. By doing so, the power to pull back the toner as mentioned above is eliminated, and thus excellent developing properties can be obtained.

However, if a magnetic carrier having a core particle having low resistance was merely used in order to drain the counter electric charge, in some cases, an electrostatic latent image on an electrostatic image carrier and a toner image are disturbed. This is because the resistance of the magnetic carrier is so low that a leakage of an electric charge between the electrostatic image carrier and the developer carrier occurs via chain formation of the magnetic carrier formed on the developer carrier, and this in turn leads to disturbance of the electrostatic latent image and the toner image. In order to improve the developing properties without disturbing the electrostatic latent image, control of carrier's electric properties in such a manner as to drain the counter electric charge to the developer carrier without the leakage of an electric charge between the developer carrier and the electrostatic image carrier is important.

In view of the above, the present inventors have found that, in the magnetic carrier particles produced by filling pores of the porous magnetic core with a resin, the above-mentioned problems could be solved by controlling the existence state of the magnetic core part and the resin part inside the particles. Specifically, the magnetic carrier having magnetic carrier particles produced by filling pores of porous magnetic core particles with a resin need to satisfy the following. Namely, on the 18 straight lines drawn at intervals of 10° which pass through a reference point of a cross section of the magnetic carrier particle in a reflected electron image of the cross section of the magnetic carrier particle photographed by a scanning electron microscope, the number of magnetic core regions having a length of 6.0 μm or longer is from 5.0 to 35.0% by number (inclusive) relative to the total number of the magnetic core region having a length of 0.1 μm or longer, and the number of regions other than the magnetic core part having a length of 4.0 μm or longer is from 1.0 to 15.0% by number (inclusive) relative to the total number of the region other than the magnetic core part having a length of 0.1 μm or longer. By controlling the inner structure of the magnetic carrier in such a manner as mentioned above, the magnetic carrier having excellent developing properties without disturbance of the electrostatic latent image due to the leakage as mentioned above can be obtained. Though the detailed reason for this is not clear yet, inventors of the present invention assume the following for it.

At the time of image formation, a plurality of magnetic carrier particles form a chain in the state of a point-to-point contact on the developer carrier. Especially in the developing region where the toner is developed to the electrostatic image carrier, the magnetic carrier particles line up on a nearly straight line along a magnetic force line. At this time, each magnetic carrier particle comes in contact with its adjacent magnetic carrier particles at two points (poles). A straight line connecting the contact points (a straight line connecting the two poles) is a diameter of the magnetic carrier particle. Usually, an electric charge moves on the diameter line, which is the shortest path.

Here, a porous magnetic core particle is a bound body of grains (sintered primary particle) obtained by sintering various fine particles at high temperature. The bound body of the grains corresponds to the magnetic core region of the magnetic carrier particle. The state of the body greatly affects strength and electric properties as the carrier. The above-mentioned counter electric charge moves via the magnetic core region inside the magnetic carrier particle. In the case of the porous magnetic core particle which has been proposed so far, the contacting area of grains is small because the grains are small, and thus adhesion among grains is low. Accordingly, an electric charge among grains cannot move smoothly, thereby the counter electric charge resides inside the carrier, resulting in pull back of a toner, which in turn causes difficulty in toner development in some cases.

To solve this problem, it is necessary to make the transfer of the electric charge among grains smooth by making grains relatively large in the porous magnetic core particle and controlling the binding in such a way as to secure a large contacting area among grains.

As a result of investigation based on the above-mentioned finding, it was found that the smooth transfer of the counter electric charge among grains and the excellent developing properties could be obtained by controlling, on 18 straight lines passing through a reference point of a cross section of the magnetic carrier particle drawn at intervals of 10°, the number of magnetic core regions having a length of 6.0 μm or longer from 5.0 to 35.0% by number (inclusive). More advantageously, the number of magnetic core regions having a length of 6.0 μm or longer on the straight lines is from 10.0 to 30.0% by number (inclusive). In addition, it is advantageous that the magnetic core region longer than 25.0 μm do not exist.

When the number of magnetic core regions having a length of 6.0 μm or longer is less than 5.0% by number, the counter electric charge with a reverse polarity to the toner which remains inside a magnetic carrier cannot be drained smoothly from the magnetic carrier surface, resulting in difficult toner development. When the number of magnetic core regions having a length of 6.0 μm or longer is more than 35.0% by number, the leakage of an electric charge via chain formation of the magnetic carriers tends to occur easily.

On the other hand, in order to prevent leakage of an electric charge between the electrostatic image carrier and the developer carrier via chain formation of the magnetic carrier formed on the developer carrier, the existence state of "the region other than the magnetic core part" is important. Namely, the region other than the magnetic core part corresponds to pores of the porous magnetic core particle, and in the present invention a resin is filled in most of this region. An electric charge does not move via a resin basically, and thus the leakage is more difficult to occur with a larger ratio of the pores in the porous magnetic core particle. Accordingly, to define the existence state of the region other than the magnetic core part in a cross section of the carrier particle is important.

Accordingly, in the carrier particle of the present invention, the number of regions other than the magnetic core part having a length of 4.0 μm or longer on the 18 straight lines drawn at intervals of 10° which pass through a reference point of a cross section of the magnetic carrier particle is from 1.0 to 15.0% by number (inclusive). More advantageously, the number of regions other than the magnetic core part having a length of 4.0 μm or longer is from 2.0 to 10.0% by number (inclusive). In addition, it is advantageous that the region other than the magnetic core region having a length of longer than 12.0 μm do not exist.

When the number of regions other than the magnetic core part having a length of 4.0 μm or longer is within the above-mentioned range, the leakage of an electric charge between the electrostatic image carrier and the developer carrier can be prevented even under the flow of the counter electric charge.

When the length of the region other than the magnetic core part is less than 4.0 μm, the distance between the magnetic core regions is small and an electric current flows also in the region other than the magnetic core part because the developing region is in a high electric field, and thus suppression of the leakage becomes difficult. As a result, a flow of the electric charge cannot be controlled sufficiently.

When the number of regions other than the magnetic core part having a length of 4.0 μm or longer is less than 1.0% by number, the leakage of an electric charge between the electrostatic image carrier and the developer carrier via chain formation of the carrier occurs readily, thereby disturbing an electrostatic latent image and a toner image in some cases. In addition, because pores of the porous magnetic core particle cannot contain a resin sufficiently, a physical strength of the magnetic carrier particle decreases. As a result, a part of the magnetic carrier is destroyed during long-term durability use, which leads to the carrier adhesion and the fogging due to decrease in the chargeability in some cases.

When the number of regions other than the magnetic core part having a length of 4.0 μm or longer is more than 15.0% by number, difference in specific gravity within magnetic carrier particles increases thereby decreases in fluidity of the magnetic carrier, resulting in the image density variation in some cases. Further, the carrier is excessively charged electrically, resulting in decrease in developing properties in some cases.

As mentioned above, in order to suppress the leakage of an electric charge between the developer carrier and the electrostatic image carrier while draining the counter electric charge to the developer carrier, it is important that the relationship between the magnetic core region and the region other than the magnetic core part in the cross section of the carrier particle satisfy the range defined by the present invention.

In the magnetic carrier of the present invention, the total number of the magnetic core region having a length of 0.1 μm or longer on the 18 straight lines drawn at intervals of 10° which pass through a reference point of a cross section of the magnetic carrier particle is advantageously from 50 to 250 (inclusive), and more advantageously from 70 to 200 (inclusive). In addition, the total number of the region other than the magnetic core part having a length of 0.1 μm or longer on the above-mentioned straight lines is advantageously from 50 to 250 (inclusive), and more advantageously from 70 to 200 (inclusive). When the total number of each region is within the above-mentioned range, a filling amount of a resin into pores of the porous magnetic core particle can be easily controlled, and thus the flow of an electric charge inside the magnetic carrier can be controlled more easily.

In addition, it is necessary that, in the magnetic carrier of the present invention, the ratio of the magnetic carrier particles satisfying the range of the percentage by number of the magnetic core region having a length of 6.0 μm or longer and the percentage by number of the region other than the magnetic core part having a length of 4.0 μm or longer, as defined above, be 80% or more by number relative to the total carrier particles. Further, the ratio of the above-mentioned magnetic carrier particles is more advantageously 92% or more by number.

In the magnetic carrier particle of the present invention, the ratio of the area of the magnetic core region to the total area of the cross section of the magnetic carrier particle is advantageously from 50 to 90% by area (inclusive) in a reflected electron image photographed by a scanning electron microscope.

When the area ratio of the magnetic core region of the magnetic carrier is made within the above-mentioned range, a specific gravity of the magnetic carrier can be controlled small, and in addition physical strength can be secured satisfactorily. As a result, miscibility with the toner is improved further and at the same time the stress on the carrier at the time of mixing can be reduced, and thus stable image quality can be secured for long.

The magnetic carrier particles of the present invention are advantageously particles where a surface of the particles produced by filling pores of porous magnetic core particles with a resin is further coated with a resin. By coating the surface of the particle filled with a resin further with a resin, an environmental stability improves further. Especially even under an environment of a high temperature and a high humidity, the thus coated carrier is excellent against fogging and change in the image density caused by decrease in the charged electric amount.

The porous magnetic core particle has very small asperities on its surface formed by crystal growth in formation of the particle. These asperities also affect the surface character of the magnetic carrier particle after a resin is filled, resulting in a minute difference in the chargeability by friction between a depressed portion and a raised portion in some cases. Especially when the particle is left under the environment of a high temperature and a high humidity, the electric amount charged by friction in the toner decreases readily. When an image was generated under this state, there was a case that the change in image density was large. Accordingly, by coating the surface of the particle having a filled resin further with a resin, the difference due to asperities is decreased, and thus the problem as mentioned above can be remedied.

Furthermore, in the magnetic carrier of the present invention, the area ratio of the void part region not filled with the resin is advantageously 15% or less by area and more advantageously 10% or less by area relative to the total area of the cross section of the magnetic carrier particle in a reflected electron image photographed by a scanning electron microscope.

When the area ratio of the void part region not filled with the resin in the magnetic carrier is within the above-mentioned range, pores of the porous magnetic core particle are filled with the resin satisfactorily, and thus the magnetic carrier is excellent in physical strength and not destroyed readily even under a stress during long-term durability use. Furthermore, the above-mentioned range is also advantageous in order to control the flow of an electric charge inside the magnetic carrier particle as mentioned above.

Then, the porous magnetic core will be described. In the present invention, the term "porous magnetic core" means an aggregate of a number of porous magnetic core particles. It is important that the porous magnetic core particles have pores connecting from the surface of the magnetic core particle to its inside. The magnetic carrier can have an increased strength and excellent developing properties by filling the pores with a resin.

Materials for the porous magnetic core particle are advantageously a magnetite or a ferrite, while a ferrite is more advantageous.

The ferrite is a sintered body represented by the following formula:

$$(M1_2O)_x(M2O)_y(Fe_2O_3)_z$$

wherein, M1 represents a monovalent metal, M2 represents a divalent metal, and when $x+y+z=1.0$, x and y are respectively $0 \leqq (x, y) \leqq 0.8$, and z is $0.2<z<1.0$.

In the above formula, M1 and M2 are advantageously one or more metal atoms selected from the group consisting of Li, Fe, Mn, Mg, Sr, Cu, Zn, Ni, Co, and Ca. Specific examples thereof are metal compounds including magnetic Li ferrites such as $(Li_2O)_a(Fe_2O_3)_b$ ($0.0<a<0.4$, $0.6\leqq b<1.0$, and $a+b=1$) and $(Li_2O)_a(SrO)_bFe_2O_3)_c$ ($0.0<a<0.4$, $0.0<b<0.2$, $0.4\leqq c<1.0$, and $a+b+c=1$); Mn ferrites such as $(MnO)_a(Fe_2O_3)_b$ ($0.0<a<0.5$, $0.5\leqq b<1.0$, and $a+b=1$); Mn—Mg ferrites such as $(MnO)_a(MgO)_b(Fe_2O_3)_c$ ($0.0<a<0.5$, $0.0<b<0.5$, $0.5\leqq c<1.0$, and $a+b+c=1.0$); Mn—Mg—Sr ferrites such as $(MnO)_a(MgO)_b(SrO)_c(Fe_2O_3)_d$ ($0.0<a<0.5$, $0.0<b<0.5$, $0.0<c<0.5$, $0.5\leqq d<1.0$, and $a+b+c+d=1$); and Cu—Zn ferrites such as $(CuO)_a(ZnO)_b(Fe_2O_3)_c$ ($0.0<a<0.5$, $0.0<b<0.5$, $0.5\leqq c<1.0$, and $a+b+c=1$). The above-mentioned ferrites may contain a minute amount of other metals.

In order to make a porous structure and a state of asperities on the core surface suitable, Mn-containing ferrites, namely, Mn ferrites, Mn—Mg ferrites, and Mn—Mg—Sr ferrites, are more advantageous in view of easy control of the growth rate of the ferrite crystal and appropriate control of the specific resistance of the porous magnetic core.

In the following, the manufacturing steps when a ferrite is used as the porous magnetic core will be described in detail.

Step 1 (Step of Weighing and Mixing):

Weighed amounts of ferrite raw materials are taken into a mixing apparatus, and then crushed and mixed for a time ranging from 0.1 hour to 20.0 hours (inclusive). Examples of the ferrite raw materials include Li, Fe, Zn, Ni, Mn, Mg, Co, Cu, Ba, Sr, Y, Ca, Si, V, Bi, In, Ta, Zr, B, Mo, Na, Sn, Ti, Cr, µl, a metal particle of a rare earth metal, an oxide of a metal element, a hydroxide of a metal element, an oxalic acid salt of a metal element, and a carbonate salt of a metal element.

The mixing apparatus includes a ball mill, a planetary mill, a giotto mill, and a vibration mill. Especially, a ball mill is advantageous in view of mixing performance.

Step 2 (Step of Tentative Calcination):

The ferrite raw material mixture is tentatively calcined in an air at a calcination temperature ranging from 700° C. to 1,000° C. (inclusive) and with the time ranging form 0.5 hours to 5.0 hours (inclusive) to make a ferrite from the raw materials. For calcination, a burner-type calcination furnace, a rotary-type calcination furnace, or an electric furnace is used, for example.

Step 3 (Step of Crushing):

Tentatively calcined ferrite obtained in Step 2 is crushed by a crushing machine.

There is no restriction in the crushing machine as far as a desired particle diameter can be obtained.

Examples of the crushing machine include a crusher, a hammer mill, a ball mill, a bead mill, a planetary mill, and a giotto mill.

The 50% particle diameter on a volume basis (D50) of a pulverized product of the tentatively calcined ferrite is advantageously from 0.5 µm to 5.0 µm (inclusive), and the 90% particle diameter on a volume basis (D90) is advantageously from 2.0 µm to 7.0 µm (inclusive). Further, D90/D50, the indicator of the particle size distribution of the pulverized product of the tentatively calcined ferrite, is advantageously from 1.5 to 10.0 (inclusive). With these, the percentage by number of the magnetic core region and the percentage by number of the region other than the magnetic core part can be readily controlled within the range defined in the present invention.

In order to obtain the pulverized product of the tentatively calcined ferrite having the above-mentioned particle diameter, in the case of a ball mill and a bead mill for example, it is advantageous to select a material for a ball and a bead and to control an operation time. Specifically, in order to obtain the tentatively calcined ferrite having a smaller particle diameter, a ball with a higher specific gravity may be selected, or a crushing time may be made longer. Furthermore, in order to control the particle size distribution of the pulverized product of the tentatively calcined ferrite within the above-mentioned range, mixing a plurality of tentatively calcined ferrites having different particle diameters is advantageous.

The material for the ball and the bead is not particularly restricted as far as an intended particle diameter and a distribution can be obtained. Examples thereof include glasses such as soda glass (specific gravity of 2.5 g/cm$^3$), sodaless glass (specific gravity of 2.6 g/cm$^3$), and soda glass with a high specific gravity (specific gravity of 2.7 g/cm$^3$); quartz (specific gravity of 2.2 g/cm$^3$); titania (specific gravity of 3.9 g/cm$^3$); silicon nitride (specific gravity of 3.2 g/cm$^3$); alumina (specific gravity of 3.6 g/cm$^3$); zirconia (specific gravity of 6.0 g/cm$^3$); steel (specific gravity of 7.9 g/cm$^3$); and stainless steel (specific gravity of 8.0 g/cm$^3$). Among them, alumina, zirconia, and stainless steel are advantageous in view of good abrasion resistance.

The size of the ball and the bead is not particularly restricted as far as intended particle diameter and distribution can be obtained. For example, the ball with a diameter from 5 mm to 60 mm (inclusive) is suitably used, and the bead with a diameter from 0.03 mm to 5 mm (inclusive) is suitably used. In a ball mill and in a bead mill, the wet type shows a higher crushing efficiency than the dry type, because the crushed product is not stirred up in the mill. Accordingly, the wet type is advantageous to the dry type.

Step 4 (Step of Granulation):

Pulverized product of the tentatively calcined ferrite may be added by a dispersing agent, water, a binder, and, as appropriate, a pore controlling agent.

Examples of the pore controlling agent include a blowing agent and fine resin particles. Examples of the blowing agent include sodium bicarbonate, potassium bicarbonate, lithium bicarbonate, ammonium bicarbonate, sodium carbonate, potassium carbonate, lithium carbonate, and ammonium carbonate. Examples of the fine resin particles include fine particles of a polyester; polystyrene; styrene copolymer such as styrene vinyl toluene copolymer, styrene vinyl naphthalene copolymer, a styrene acrylate ester copolymer, a styrene methacrylate ester copolymer, styrene methyl α-chloromethacrylate ester copolymer, styrene acrylonitrile copolymer, styrene vinyl methyl ketone copolymer, styrene butadiene copolymer, styrene isoprene copolymer, and styrene acrylonitrile indene copolymer; polyvinyl chloride; a phenol resin; a modified phenol resin; a malein resin; an acryl resin; a methacryl resin; polyvinyl acetate; a silicon resin; a polyester resin having a monomer selected from an aliphatic polyalcohol, an aliphatic dicarboxylic acid, an aromatic dicarboxylic acid, aromatic dialcohols, and diphenols as its structure unit; a polyurethane resin; a polyamide resin; polyvinyl butyral; a terpene resin; a cumarone indene resin; a petroleum resin; and a hybrid resin having a polyester unit and a vinyl polymer unit. Example of the binder includes a polyvinyl alcohol.

In the case that the crushing in Step 3 is done with the wet type, in light of water contained in the ferrite slurry, it is advantageous to add a binder and, as appropriate, a pore controlling agent.

The thus obtained ferrite slurry is dried and granulated by an atomization drier at a heating temperature ranging from 100° C. to 200° C. (inclusive). There is no particular restriction in the atomization drier as far as an intended particle diameter of the porous magnetic core is obtained. For example, a spray drier may be used.

Step 5 (Step of Main Calcination):

Then, a granulated product is calcined at the temperature ranging from 800° C. to 1,300° C. (inclusive) and with the time ranging from 1 hour to 24 hours (inclusive). The temperature ranging from 1,000° C. to 1,200° C. (inclusive) is more advantageous. By making the time for raising the temperature shorter and the time for lowering the temperature longer, the rate of crystal growth can be controlled to obtain an intended porous structure. The holding time of the calcination temperature is advantageously from 3 hours to 5 hours (inclusive) in order to obtain an intended porous structure. In order to obtain the area ratio ranging from 50 to 90% by area (inclusive) in the magnetic core region of the cross section of the magnetic carrier particle, it is advantageous to control the calcination temperature and the calcination time within the above-mentioned ranges. Calcination of the porous magnetic core is facilitated by raising the calcination temperature or making the calcination time longer, thereby resulting in a larger area ratio of the magnetic core region.

Step 6 (Step of Classification):

After the calcined particles are parted as mentioned above, coarse particles or fine particles may be removed, as appropriate, by sieving them with a classifier or a sieve machine.

Here, the 50% particle diameter on a volume basis (D50) is advantageously from 18.0 μm to 58.0 μm (inclusive) in view of improved chargeability by friction to the toner and suppression of the fogging and the carrier adhesion to the image.

The porous magnetic core obtained in the way as mentioned above is prone to a poor physical strength and thus readily breakable depending on the number or the size of the pore. Because of this, the carrier particle of the present invention is filled with a resin in pores of the porous magnetic core particle.

The method for filling a resin into pores of the above-mentioned porous core particle is not particularly restricted. The method in which a resin solution obtained by mixing a resin and a solvent is penetrated into pores of the porous magnetic core particle and then the solvent is removed is advantageous. In the case that the resin is soluble in an organic solvent, the organic solvent such as toluene, xylene, cellosolve butyl acetate, methyl ethyl ketone, methyl isobutyl ketone, and methanol may be used. In the case that the resin is water-soluble or of an emulsion type, water may be used as the solvent.

The amount of the resin as the solid content in the above-mentioned resin solution is advantageously from 1 to 30% by mass (inclusive), and more advantageously from 5 to 20% by mass (inclusive). When the resin solution with the resin amount of more than 30% by mass is used, the resin solution cannot readily penetrate into pores of the porous magnetic core particle uniformly because of a high viscosity. When the amount is less than 1% by mass, the resin amount is so small that removal of the solvent takes longer time, resulting in nonuniform filling or poor adhesion strength of the resin to the porous magnetic core particle in some cases.

The resin used to fill the pores of the above-mentioned porous magnetic core particle is not particularly restricted. Any of a thermoplastic resin and a thermosetting resin may be used, and the one having a high affinity for the porous magnetic core is advantageous. When the resin having a high affinity is used, a surface of the resin-filled magnetic carrier can be coated readily by a resin after pores of the porous magnetic core particle are filled by the resin.

Examples of the above-mentioned thermoplastic resin include polystyrene, polymethyl methacrylate, a styrene acryl resin, styrene-butadiene copolymer, ethylene-vinyl acetate copolymer, polyvinyl chloride, polyvinyl acetate, a polyvinylidene fluoride resin, a fluorocarbon resin, a perfluorocarbon resin, polyvinyl pyrrolidone, a petroleum resin, a novolak resin, a saturated alkyl polyester resin, polyethylene terephthalate, polybutylene terephthalate, polyarylate, a polyamide resin, a polyacetal resin, a polycarbonate resin, a polyether sulfone resin, a polysulfone resin, a polyphenylene sulfide resin, and a polyether ketone resin.

Examples of the above-mentioned thermosetting resin include a phenol resin, a modified phenol resin, a malein resin, an alkyd resin, an epoxy resin, an unsaturated polyester (obtained by polycondensation of maleic anhydride, terephthalic acid, and a polyalcohol), an urea resin, a melamine resin, an urea-melamine resin, a xylene resin, a toluene resin, a guanamine resin, a melamine guanamine resin, an acetoguanamine resin, a glyptal resin, a furane resin, a silicone resin, a polyimide, a polyamide imide resin, a polyether imide resin, and a polyurethane resin.

These resins may also be modified for use. Among them, polyvinylidene fluoride resin, a fluorocarbon resin, a fluorinated resin such as a perfluorocarbon resin or a solvent-soluble perfluorocarbon resin, and a modified silicone resin or a silicone resin are advantageous because of their high affinity for the porous magnetic core particles.

Among the above-mentioned resins, a silicone resin is particularly advantageous. A silicone resin heretofore known may be used as the silicone resin.

Examples of the commercially available silicone resins include KR 271, KR 255, and KR 152 (all manufactured by Shin-Etsu Chemical Co., Ltd.); and SR 2400, SR 2405, SR 2410, and SR 2411 (all manufactured by Dow Corning Toray Co., Ltd.). Examples of the modified silicone resins include KR 206 (alkyd modified), KR 5208 (acryl modified), ES 1001N (epoxy modified), and KR 305 (urethane modified) (all manufactured by Shin-Etsu Chemical Co., Ltd.); and SR 2115 (epoxy modified) and SR 2110 (alkyd modified) (both manufactured by Dow Corning Toray Co., Ltd.).

The amount of the resin to be filled in pores of the porous magnetic core particle is advantageously from 5.0 to 25.0 parts by mass (inclusive) relative to 100 parts by mass of the porous magnetic core in view of controllability of the ease of the leakage inside the magnetic carrier particle. More advantageous amount is from 8.0 to 20.0 parts by mass (inclusive).

It is advantageous that the magnetic carrier of the present invention be used after pores of the porous magnetic core particle are filled with a resin and then further its surface is coated with a resin in the light of the control of a releasability, an anti-fouling property, a chargeability by friction, a resistance of the magnetic carrier, and the like. In this case, the resin used for filling and the resin used as a coating material for coating may be the same or different, and a thermoplastic resin or a thermosetting resin.

The resin to form the above-mentioned coating material is exemplified by the above-mentioned thermoplastic resins and the above-mentioned thermosetting resins. Modified resins of these resins may also be used. Examples thereof include a fluorinated resin such as a polyvinylidene fluoride resin, a fluorocarbon resin, a perfluorocarbon resin or a solvent-soluble perfluorocarbon resin, and a modified silicone resin.

Among the above-mentioned resins, a silicone resin is particularly advantageous. A silicone resin heretofore known may be used as the silicone resin. Examples of the commercially available silicone resins include KR 271, KR 255, and KR 152 (all manufactured by Shin-Etsu Chemical Co., Ltd.); and SR 2400, SR 2405, SR 2410, and SR 2411 (all manufactured by Dow Corning Toray Co., Ltd.). Examples of the modified silicone resins include KR 206 (alkyd modified), KR 5208 (acryl modified), ES 1001N (epoxy modified), and KR 305 (urethane modified) (all manufactured by Shin-Etsu Chemical Co., Ltd.); and SR 2115 (epoxy modified) and SR 2110 (alkyd modified) (both manufactured by Dow Corning Toray Co., Ltd.).

The above-mentioned resins may be used singly or as a mixture of them. In addition, a thermosetting resin may be used by mixing with a curing agent and the like and being cured. Especially, a resin having a further higher releasability is suitably used.

The amount of the resin for coating the surface of the porous magnetic core particle filled with a resin is advantageously from 0.1 to 3.0 parts by mass (inclusive) relative to 100 parts by mass of the porous magnetic core particle filled with a resin. The amount is more advantageously from 0.3 to 2.0 parts by mass (inclusive). When the coating amount is made within the above-mentioned range, the chargeability by friction of the magnetic carrier and an environmental stability can be improved.

In addition, a conductive particle or a charge controlling particle may be mixed for use as the coating resin. Examples of the conductive particle include carbon black, magnetite, graphite, zinc oxide, and tin oxide. The amount to be added is advantageously from 0.1 to 10.0 parts by mass (inclusive) relative to 100 parts by mass of the coating material in view of control of the resistance of the magnetic carrier.

Examples of the charge controlling particle include an organometallic complex particle, an organometallic salt particle, a chelate compound particle, a monoazo metal complex particle, an acetylacetone metal complex particle, a hydroxycarboxylic acid metal complex particle, a polycarboxylic acid metal complex particle, a polyol metal complex particle, a polymethyl methacrylate resin particle, a polystyrene resin particle, a melamine resin particle, phenol resin particle, a nylon resin particle, a silica particle, a titanium oxide particle, and an alumina particle. The amount of the charge controlling particles to be added is advantageously from 0.5 to 50.0 parts by mass (inclusive) relative to 100 parts by mass of the coating resin in view of control of the amount of the electric amount charged by friction. Especially there may be mentioned the following charge controlling materials to be used in a silicone resin.

Namely, the examples include γ-aminopropyl trimethoxy silane, γ-aminopropyl methoxy diethoxy silane, γ-aminopropyl triethoxy silane, N-β-(aminoethyl)-γ-aminopropyl trimethoxy silane, N-β-(aminoethyl)-γ-aminopropyl methyl dimethoxy silane, N-phenyl-γ-aminopropyl trimethoxy silane, ethylene diamine, diethylene triamine, styrene-dimethylaminoethyl acrylate copolymer, styrene-dimethylaminoethyl methacrylate copolymer, isopropyl tri(N-aminoethyl)titanate, hexamethyl disilazane, methyl trimethoxy silane, butyl trimethoxy silane, isobutyl trimethoxy silane, hexyl trimethoxy silane, octyl trimethoxy silane, decyl trimethoxy silane, dodecyl trimethoxy silane, phenyl trimethoxy silane, o-methylphenyl trimethoxy silane, and p-methylphenyl trimethoxy silane.

The method for further coating a surface of the magnetic carrier filled with a resin with the resin after pores of the porous magnetic core particle are filled with a resin is not particularly restricted. Examples of the applying method to be used for the coating include a dipping method, a spray method, a brush coating method, and a fluidized bed method.

The 50% particle diameter on a volume distribution basis (D50) of the magnetic carrier of the present invention is advantageously from 20.0 μm to 60.0 μm (inclusive). The above-mentioned specific range is advantageous in view of the chargeability by friction to the toner and the suppression of the carrier adhesion and the fogging. Here, the 50% particle diameter (D50) of the magnetic carrier may be controlled by a wind classification and a sieve classification.

Then, the toner contained along with the magnetic carrier in the two component developer of the present invention will be described. In the toner used in the present invention, the content of the particle having a diameter of 4.0 μm or less on a number basis is advantageously 35.0% or less by number and the content of the particle having a diameter of 12.7 μm or more on a volume basis is advantageously 3.0% or less by volume in order to obtain both high quality image and durability. When the particle size distribution of the toner is within the above-mentioned range, fluidity of the toner is excellent, sufficient charged electric amount can be readily obtained, and fogging can be suppressed easily.

Further, the weight-average particle diameter (D4) of the toner is advantageously from 4.5 μm to 10.0 μm (inclusive), and more advantageously from 5.0 μm to 9.0 μm (inclusive). When the weight-average particle diameter (D4) of the toner is within the above-mentioned range, the dot reproducibility improves further.

The average circularity of the toner used in the present invention is advantageously from 0.940 to 1.000 (inclusive). When the average circularity of the toner is within the above-mentioned range, the releasability of the carrier and the toner is excellent. Here, the average circularity is based on the circularity distribution of the circle equivalent diameter ranging from 1.985 μm to 39.69 μm (inclusive), wherein the circularity measured by a flow-type particle image measurement apparatus with an image processing resolution power of 512×512 pixels (0.37 μm×0.37 μm per one pixel) in one visual field is divided into 800 in the range from 0.200 to 1.000 (inclusive) of the circularity for analysis.

When the toner with the average circularity being within the above-mentioned range is used with the magnetic carrier of the present invention, fluidity as the developer can be appropriately controlled. As a result, transportation properties of the two component developer on the developer carrier become excellent and the toner can be released readily from the magnetic carrier, and thus the toner can be developed more easily.

A binding resin having the following properties is advantageous in order to satisfy both storage stability and low-temperature fixing properties. Namely, the peak molecular weight (Mp) of the molecular weight distribution is from 2,000 to 50,000 (inclusive), the number-average molecular weight (Mn) is from 1,500 to 30,000 (inclusive), the weight-average molecular weight (Mw) is from 2,000 to 1,000,000 (inclusive), as measured by a gel permeation chromatography (GPC), and the glass transition temperature (Tg) is from 40° C. to 80° C. (inclusive).

The toner may contain a wax, the amount of which is advantageously from 0.5 to 20 parts by mass (inclusive) relative to 100 parts by mass of the binding resin. The peak temperature of the maximum endothermic peak of the wax is advantageously from 45° C. to 140° C. (inclusive). The peak temperature within the above-mentioned range is advantageous, because a toner storage stability and a hot offset property can be satisfied at the same time.

Examples of the wax include a hydrocarbon wax such as a low-molecular weight polyethylene, a low-molecular weight polypropylene, a paraffin wax, and a Fischer-Tropsch wax; an oxidation product of a hydrocarbon wax such as oxidized polyethylene wax or their block copolymer; waxes mainly containing an aliphatic ester, such as a carnauba wax, a behenyl behenate ester wax, and a montanate ester wax; and partly or totally deacidified aliphatic esters such as deacidified carnauba wax.

The use amount of an colorant is advantageously from 0.1 to 30.0 parts by mass (inclusive), more advantageously from 0.5 to 20.0 parts by mass (inclusive), and most advantageously from 3.0 to 18.0 parts by mass (inclusive), relative to 100 parts by mass of the binding resin. Particularly, the amount is from 8.0 to 15.0 parts by mass for a black toner, from 8.0 to 18.0 parts by mass for a magenta toner, from 6.0 to 12.0 parts by mass for a cyan toner, and from 8.0 to 17.0 parts by mass for a yellow toner. The use amount within the above-mentioned range is advantageous in view of dispersibility and chromogenic properties of the colorant.

The toner may also contain a charge controlling agent as appropriate. As the charge controlling agent contained in the toner, a heretofore known agent may be used, though a colorless metal compound of an aromatic carboxylic acid having a fast charging rate by friction with stably keeping the charged electric amount by friction at a certain level is particularly advantageous.

Examples of the negative charge controlling agent include a salicylic acid metal compound, a naphthoic acid metal compound, a dicarboxylic acid metal compound, a polymer-type compound having a sulfonic acid or a carboxylic acid in its side chain, a polymer-type compound having a sulfonic acid salt or a sulfonic acid ester in its side chain, a polymer-type compound having a carboxylic acid salt or a carboxylic acid ester in its side chain, a boron compound, an urea compound, a silicon compound, and a calixarene. The charge controlling agent may be added internally or externally to the toner particle. The amount of the charge controlling agent to be added is advantageously from 0.2 to 10.0 parts by mass (inclusive) relative to 100 parts by mass of the binding resin.

It is advantageous to add an external additive in order to improve its fluidity. Inorganic fine particles such as silica, titanium oxide, and aluminum oxide are advantageous as the external additive. It is advantageous that the inorganic fine particles be made hydrophobic by a hydrophobizing agent such as a silane compound, a silicone oil, or a mixture thereof. The amount of the external additive to be used is advantageously from 0.1 to 5.0 parts by mass (inclusive) relative to 100 parts by mass of the toner particles. Mixing of the toner particles with the external additive may be done by using a heretofore known mixer such as a Henschel mixer.

Method for producing the toner particles include a crushing method in which a binding resin and a colorant are melt kneaded, and then the kneaded mixture is cooled, crushed, and classified; a suspension granulation method in which a binding resin and a colorant are dissolved or dispersed in a solvent, the resulting solution is mixed with an aqueous medium for suspension granulation, and then the solvent is removed to obtain toner particles; a suspension polymerization method in which a monomer composition obtained by homogeneously dissolving or dispersing a monomer, a colorant, and so on is dispersed in a continuous phase (for example in an aqueous phase) containing a dispersion stabilizer, and then a polymerization is carried out to obtain toner particles; a dispersion polymerization method in which toner particles are formed directly by using a monomer and an aqueous organic solvent dissolving the monomer but not dissolving the formed polymer; an emulsion polymerization method in which toner particles are formed directly by polymerization in the presence of a water-soluble polar polymerization initiator; and an emulsifying aggregation method including at least a step of forming an aggregate of fine particles by aggregating polymer fine particles and colorant fine particles and a step of aging to fuse the fine particles in the aggregate of fine particles.

Then, the procedure for toner production by a crushing method will be described.

In the step of mixing of raw materials, materials to constitute a toner particle including a binding resin, a colorant, wax, and, as appropriate, other components such as a charge controlling agent, are weighed as intended and then mixed. Examples of the mixing apparatus include a double cone mixer, a V-shape mixer, a drum mixer, a super mixer, a Henschel mixer, a Nauta mixer, and Mechano Hybrid (trade name, manufactured by Mitsui Mining Co., Ltd.).

Then, the mixed materials are melt kneaded to disperse the colorant and so on into the binding resin. In the melt kneading step, a batch kneader such as a pressure kneader and a Bunbury mixer, and a continuous kneader can be used. Because of the merit of a continuous production, a monoaxial or a biaxial extruder has been a mainstream. Examples thereof include a KTK-type biaxial extruder (manufactured by Kobe Steel, Ltd.), a TEM-type biaxial extruder (manufactured by Toshiba Machine Co., Ltd.), a PCM melt kneader (manufactured by Ikegai Corp.), a biaxial extruder (manufactured by KCK K.K.), Ko Kneader (manufactured by Buss AG), and Kneadex (manufactured by Mitsui Mining Co., Ltd.).

Then, the colored resin composition obtained by melt kneading may be rolled by a biaxial roller and the like, and then cooled by water and the like in the step of cooling.

The cooled product of the resin composition is crushed until an intended particle diameter is obtained in a step of crushing, in which the product is coarsely crushed by a crushing machine such as a crusher, a hammer mill, and a feather mill, and then pulverized, for example, by a Criptron system (manufactured by Kawasaki Heavy Industries, Ltd.), a super rotor (manufactured by Nisshin Engineering Inc.), a turbo mill (manufactured by Turbo Kogyo Co., Ltd.), and an air jet type pulverizing mill.

Thereafter, the toner particle can be obtained, as appropriate, by classification with a classifying apparatus or a sieve apparatus, such as an elbow jet using an inertia classification system (manufactured by Nittetsu Mining Co., Ltd.), Turboprex using a centrifugal classification system (manufactured by Hosokawa Micron Corp.), TSP Separator (manufactured by Hosokawa Micron Corp.), and FACULTY (manufactured by Hosokawa Micron Corp.).

In addition, after crushing, the toner particle may be surface-modified, as appropriate, by such treatment as spheronization using a hybridization system (manufactured by Nara Machinery Co., Ltd.), a mechanofusion system (manufactured by Hosokawa Micron Corp), FACULTY (manufactured by Hosokawa Micron Corp.), and Meteo Rainbow MR Type (manufactured by Nippon Pneumatic Mfg. Co., Ltd.).

Surface modification of the toner particle may also be done by using a surface modifying apparatus such as the one shown in FIG. 1. Toner particles 1 are charged inside a surface modifying apparatus 4 through a charging nozzle 3 by using an auto feeder 2. An air inside the surface modifying apparatus 4 is aspirated by a blower 9 so that the toner particles 1 charged through the charging nozzle 3 are dispersed inside the apparatus. The toner particles 1 dispersed inside the apparatus are heated instantaneously by a heated air introduced from a heated air inlet 5 for surface modification. Although it is desirable to generate a heated air by a heater, the apparatus is not particularly restricted as far as the apparatus generates a sufficient heated air to for surface-modification of the toner particles. The surface-modified toner particles 7 are instantaneously cooled by a cold air introduced from a cold air inlet 6. Although it is desirable that liquid nitrogen be used as the cold air, the means is not particularly restricted as far as the surface-modified toner particles 7 are cooled instantaneously.

The surface-modified toner particles 7 are aspirated by the blower 9 and collected in a cyclone 8.

The magnetic carrier of the present invention can be used as a two component developer containing a magnetic carrier and a toner. When used as the developer, the mixing ratio is made so that the toner content is advantageously from 2 to 35 parts by mass (inclusive), and more advantageously from 4 to 25 parts by mass (inclusive), relative to 100 parts by mass of the magnetic carrier. Within the above-mentioned range, a high image density can be obtained and scattering of the toner can be reduced.

The two component developer of the present invention can also be used as a replenishing developer used in a two component developing method in which the developer replenishes a development unit and at least an overloaded magnetic carrier in the development unit is drained out from the development unit. When used as a replenishing developer, in order to increase in durability of the developer, the mixing ratio is made such that the toner content is advantageously from 2 to 50 parts by mass (inclusive) relative to 1 part by mass of the magnetic carrier.

<Method for Measurements of the 50% Particle Diameter on a Volume Distribution Basis (D50) of the Magnetic Carrier and the Porous Magnetic Core, the 50% Particle Diameter on a Volume Distribution Basis (D50) of the Pulverized Product of a Tentatively Calcined Ferrite, and the 90% Particle Diameter on a Volume Distribution Basis (D90)>

The particle size distribution is measured with a particle size distribution measurement apparatus using a laser diffraction/scattering method, "Microtrac MT 3300 EX" (manufactured by Nikkiso Co., Ltd.).

The measurements of the 50% particle diameter on a volume distribution basis (D50) of the pulverized product of a tentatively calcined ferrite and the 90% particle diameter on a volume distribution basis (D90) are made with an attached sample circulation unit for a wet method, "Sample Delivery Control (SDC)" (manufactured by Nikkiso Co., Ltd.). A tentatively calcined ferrite (ferrite slurry) is added gradually into the sample circulation unit to obtain an intended concentration for the measurement. Flow rate of 70%, ultrasonic output power of 40 W, and ultrasonic dosing time of 60 seconds are employed.

The measurement conditions are as following:
Set zero time: 10 seconds
Measurement time: 30 seconds
Number of measurements: 10 times
Solvent's refractive index: 1.33
Particle's refractive index: 2.42
Particle shape: nonspherical
Upper measurement limit: 1,408 μm
Lower measurement limit: 0.243 μm
Measurement environment: about 23° C. and 50% relative humidity The measurement of the 50% particle diameter on a volume distribution basis (D50) of the magnetic carrier and the porous magnetic core is made with an attached sample charging unit for a dry method, "one-shot dry type sample conditioner Turbotrac" (manufactured by Nikkiso Co., Ltd.). Charge to Turbotrac is made by using a dust collector as a vacuum source with an air flow rate of about liters/second and a pressure of about 17 kPa. The control is made automatically on the software. The 50% particle diameter (D50) is obtained as an accumulation value on a volume distribution basis. Control and analysis are made with the attached software (version of 10.3.3-202D).

Measurement conditions are as following:
Set zero time: 10 seconds
Measurement time: 10 seconds
Number of measurements: once
Particle's refractive index: 1.81
Particle shape: nonspherical
Upper measurement limit: 1,408 μm
Lower measurement limit: 0.243 μm
Measurement environment: about 23° C. and 50% relative humidity <A Method for Measurements of the Length of the Magnetic Core Region and the Length of the Region Other than the Magnetic Core Part in the Cross Section of a magnetic carrier particle, and a method for measurement of the Area Ratio of the Magnetic Core Region>

In the process to make a cross section of a magnetic carrier particle, FB-2100 (manufactured by Hitachi High-Technologies Corp.), which is a focused ion beam process observation apparatus (FIB), is used. Carbon paste is applied on a FIB sample stage (metal mesh), and on it a small amount of magnetic carrier particles are independently adhered one by one, and then platinum is vapor deposited as a conductive layer to prepare a sample. The sample is set in the FIB apparatus and roughly processed by a Ga ion source with an acceleration voltage of 40 kV (beam current of 39 nA), and then finish-processed (beam current of 7 nA) to make a cross section of the sample.

Here, the sample magnetic carrier particles each having the maximum diameter (Dmax) in the relationship of $D50\times 0.9 \leqq Dmax \leqq D50\times 1.1$ are chosen for the measurement. In addition, Dmax is the maximum diameter when the carrier particle is observed in a parallel direction from the adhered face. Here, the distance of the position of the plate containing the maximum length in the parallel direction with the adhered face of each sample from the adhered face is taken as "h" (for example, in the case of a perfect sphere with the radius of "r", h=r). The cross section is made in a parallel direction with the adhered face in the range from 0.9×h to 1.1×h (inclusive) as the distance from the adhered face.

The sample processed to have the cross section can be used for observation with a scanning electron microscope (SEM) as it is. In the SEM observation, it is known that the more a heavy element, the larger the amount of the reflected electron emitted from the sample is. For example, in the case of the sample containing an organic compound and a metal such as iron distributed in a planar state, the reflected electrons from iron are detected more so that the part corresponding to iron is seen bright on the image (high brightness, namely white). On the other hand, the reflected electrons from the organic compound made of a light element compound are small so that the image is seen dark (low brightness, black). In the cross section observation of the magnetic carrier particle of the present invention, a metal oxide part derived from the magnetic core region is seen bright (high brightness, white), and the region other than the magnetic core part is seen dark (low brightness, black) so that a picture with a large contrast difference with each other can be obtained.

Specifically, the observation is made by using a scanning electron microscope (SEM) S-4800 (manufactured by Hitachi High-Technologies Corp.) in the following conditions. Here, the observation is made after the flushing operation.
Signal name: SE (U, LA 100)
Accelerating voltage: 5,000 volts
Emission current: 10,000 nA
Working distance: 4,000 μm
Lens mode: high
Condenser 1: 3
Scan speed: slow 4 (40 seconds)
Magnification: 1,500

Data size: 1,280×960
Color mode: gray scale
Specimen Bias: 0 V

Here, the capture of the reflected electron image is made, in addition to the above-mentioned conditions, by setting the brightness in the control software of the scanning electron microscope S-4800 at "Contrast 5, Brightness −5" and the observation mode of magnetic form at OFF to obtain a gray scale image with 256 gradations.

The length of the magnetic core region and the length of the region other than the magnetic core part (resin part and/or void part) in the cross section of the magnetic carrier particle are calculated by using an image analysis software Image-Pro Plus 5.1J (manufactured by Media Cybernetics, Inc.) on the SEM gray-scale reflected electron image of the cross section of the magnetic carrier particle by the following procedures.

Figure 2:
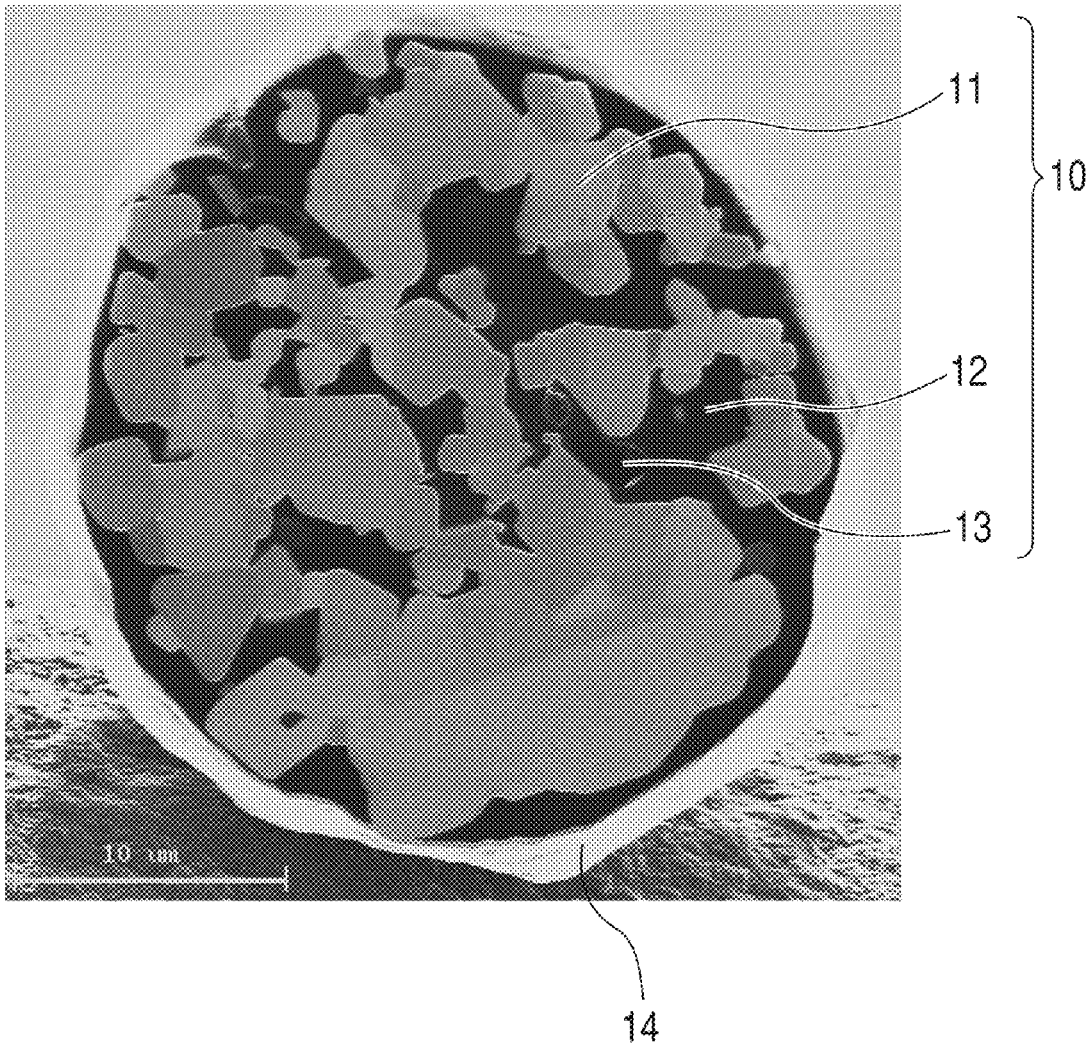
FIG. 2 is one example of a cross section of the magnetic core particle of the present invention.

Here, one example of the SEM reflected electron image of the processed cross section of the magnetic carrier particle of the present invention is shown in FIG. 2. In FIG. 2, a processed cross section region 10 of the magnetic carrier particle, a magnetic core part 11, a resin part 12, a void part 13, and a magnetic carrier surface 14 are shown.

Figure 3:
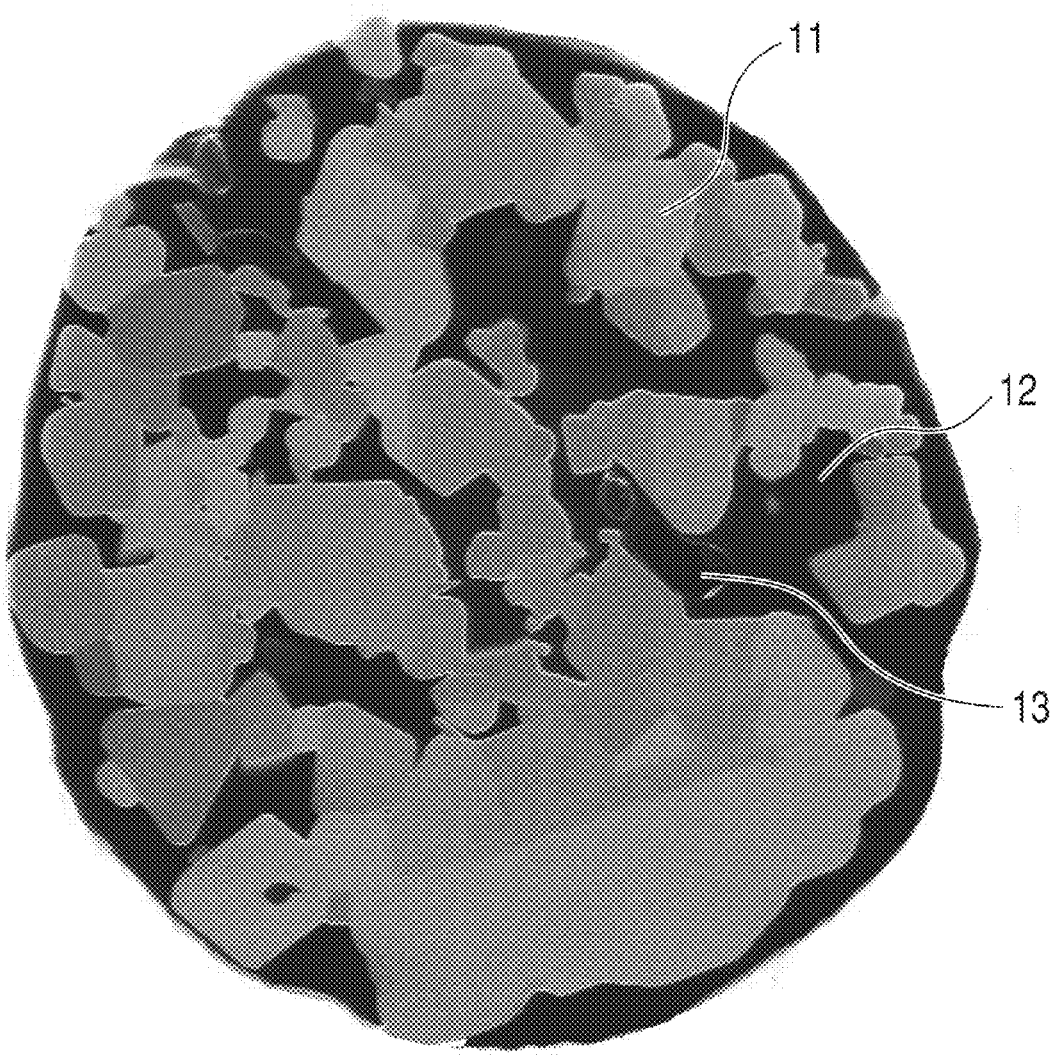
FIG. 3 is one example of a reflected electron image by SEM designating only the processed cross section region of the magnetic carrier particle of the present invention.

Only the processed cross section region 10 of the magnetic carrier particle is designated on the image in advance. Here, the boundary between the processed cross section region of the magnetic carrier particle and the background can be easily distinguished from an observed reflected electron image. The gray scale image with 256 gradations is made in the cross section region of the designated particles. The region is divided into three regions on the picture, namely, a region of the void part from the 0th to the 10th gradations from the lowest gradation value, a region of the resin part from the 11th to the 129th gradations, and a magnetic core region from the 130th to the 254th gradations. The 255th gradation is assigned to a background part other than the processed cross section region. The processed cross section region of the magnetic carrier particle is formed of the magnetic core part 11, the resin part 12, and the void part 13, as shown in FIG. 3. Here, the region other than the magnetic core part is formed of the resin part 12 and the void part 13 in the present invention.

Figure 4:
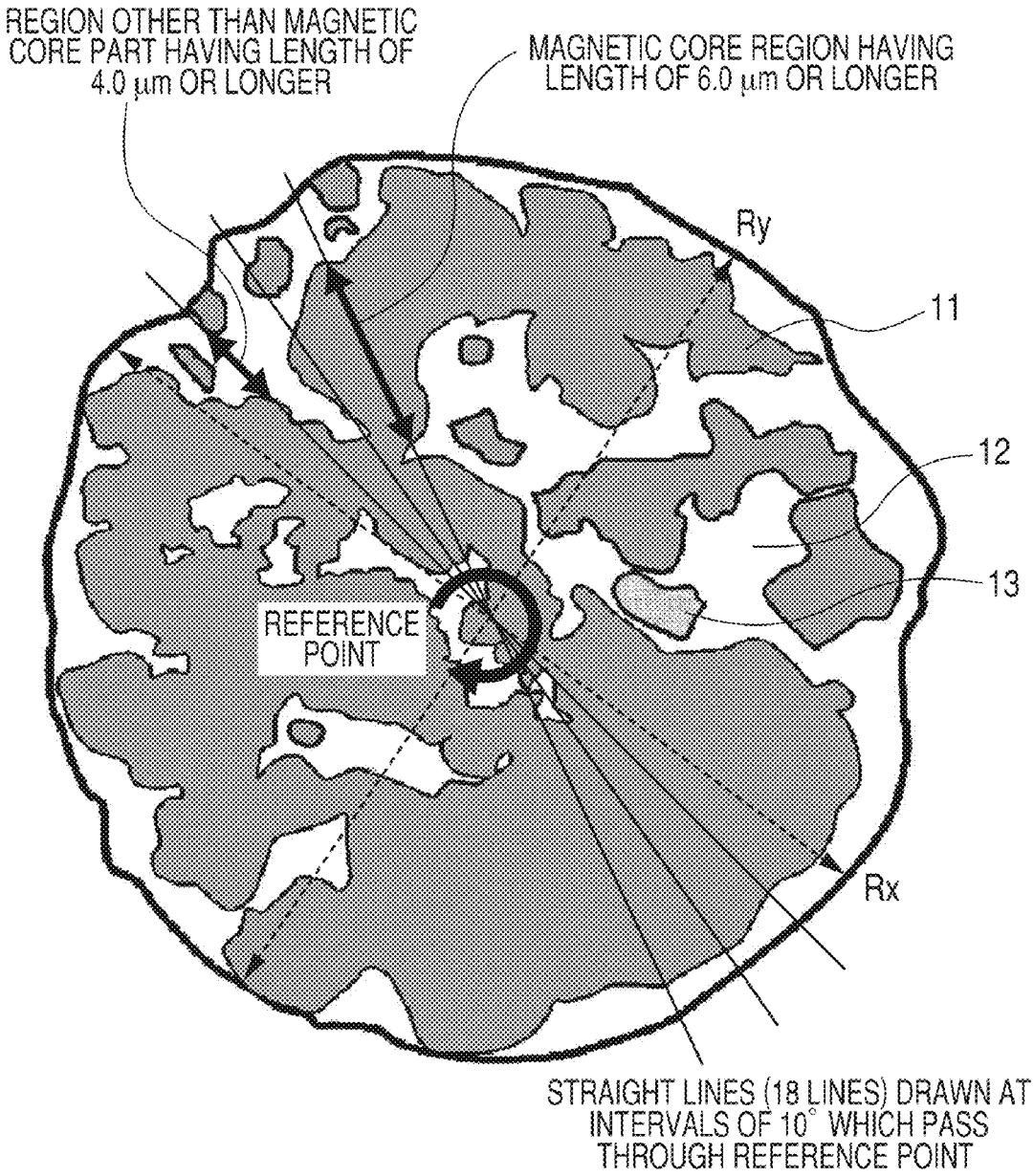
FIG. 4 is a schematic view of one measurement example of the magnetic core region and regions other than the magnetic core part in a cross section of the magnetic carrier particle of the present invention.

FIG. 4 shows a schematic drawing of a measurement example illustrating the magnetic core region and the region other than the magnetic core part in a cross section of the magnetic carrier particle of the present invention.

1. The maximum diameter of the magnetic carrier particle in the processed cross section region is shown by Rx.

2. The mid point of Rx is taken as the reference point of the cross section of the magnetic carrier particle. The diameter perpendicularly crossing with Rx at the mid point is shown by Ry.

3. The measurements are made on the magnetic carrier particles satisfying Rx/Ry≦1.2.

4. On the 18 lines drawn at intervals of 10° which pass through the reference point of a cross section of the magnetic carrier particle, the length and the number are measured on each of the magnetic core region and the region other than the magnetic core part having a length of 0.1 μm or longer. From these measurement values, the number (% by number) of "the magnetic core region having a length of 6.0 μm or longer relative to the total number of the magnetic core region having a length of 0.1 μm or longer" and the number (% by number) of "the region other than the magnetic core part having a length of 4.0 μm or longer relative to the total number of the region other than the magnetic core part having a length of 0.1 μm or longer" are taken.

5. The measurement is repeated for 25 magnetic carriers for the particles satisfying Rx/Ry≦1.2, and the average of them is calculated. The ratio of the particles satisfying Rx/Ry≦1.2 is calculated by using the number of particles necessary to reach 25 in the cutting process as the denominator.

$$\text{Ratio of particles satisfying } Rx/Ry \leqq 1.2 = 25/(\text{number of particles subjected to cutting process}) \times 100(\%) \qquad \text{Formula}$$

Figure 5:
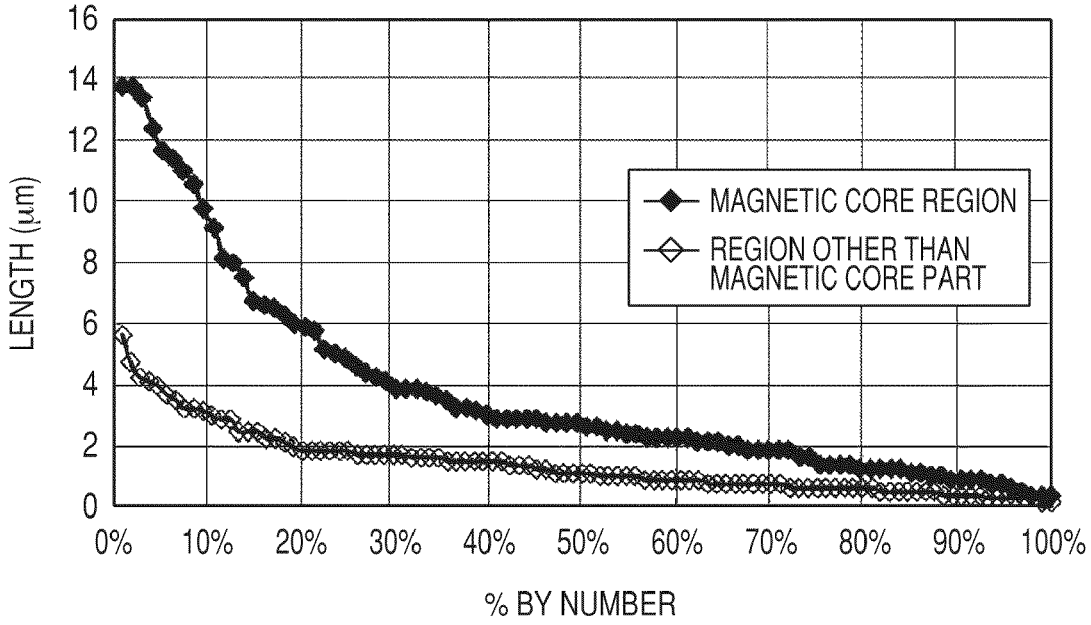
FIG. 5 is one example showing distribution of the length and the numbers (% by number) obtained by measuring the magnetic core region having a length of 0.1 μm or longer and the regions other than the magnetic core part having a length of 0.1 μm or longer in the cross section of the magnetic carrier particle of the present invention.

In FIG. 5, an example is shown for the distribution of the length and the numbers (% by number) obtained by measuring, in the method as mentioned above, the magnetic core region having a length of 0.1 μm or longer and the region other than the magnetic core part having a length of 0.1 μm or longer in the cross section of the magnetic carrier particle of the present invention.

In the measurement of the area ratio of the magnetic core part in the cross section of the magnetic carrier particle, the processed cross section region of the magnetic carrier particle is assigned in advance as the cross section area of the magnetic carrier particle. The value obtained by dividing the area occupied by the magnetic core part 1 by the cross section area of the magnetic carrier particle is taken as the "area ratio (% by area) of the magnetic core part". In the present invention, the same measurements are done for the 25 magnetic carrier particles as mentioned above to obtain the average value for use.

<Measurements of the Weight-Average Particle Diameter (D4) of the Toner, the Percent by Number of the Particles with a Diameter of 4.0 μm or Less, and the Percent by Volume of the Particles Having a Diameter of 12.7 μm or More>

The weight-average particle diameter (D4) of the toner is obtained by calculating the data obtained as following. Namely, the measurements are made with a precision particle size distribution measurement apparatus by a micro pore electric resistance method equipped with a 100 μm aperture tube, "Coulter Counter Multisizer 3" (trade name, manufactured by Beckman Coulter, Inc.), with the effective measurement channels of 25,000, wherein setting of the measurement conditions and the data analysis from the measurements are done with the dedicated software attached thereto, "Beckman Coulter Multisizer 3 Version 3.51" (manufactured by Beckman Coulter, Inc.).

The aqueous electrolyte solution obtained by dissolving the special grade sodium chloride into an ion-exchanged water (concentration of about 1% by mass), for example, "ISOTON II" (manufactured by Beckman Coulter, Inc.), can be used for the measurement.

Prior to the measurement and the analysis, the dedicated software is set as following. In the screen "change of standard operation mode (SOM)", the number 50,000 is set as the total count numbers of the control mode of the particles with one time measurement. The value obtained by "the standard particle of 10.0 μm" (manufactured by Beckman Coulter, Inc.) is set as the Kd value. By pressing the measurement button of the threshold/noise level, the threshold and the noise level are automatically set. The settings are made at 1,600 μA for the current, 2 for the gain, and ISOTON II for the electrolyte solution. The check is made on the flush of the aperture tube after the measurement. In the screen "setting of change from pulse to particle diameter" of the above-mentioned dedicated software, the logarithmic particle diameter is set for the bin distance, the particle diameter bin is set for the 256 particle diameter bin, and the particle diameter range is set from 2 μm to 60 μm.

A specific measurement method is as following.

(1) About 200 mL of the above-mentioned aqueous electrolyte solution is taken into a 250-mL round bottom glass beaker dedicated to Multisizer 3, and then the beaker is set on a sample stand. A stirring rod is rotated counterclockwise at the rate of 24 rotations/second. With the function of the "aperture flush" in the analysis software, blots and air bubbles in the aperture tube are removed.

(2) Into a 100-mL flat bottom glass beaker is taken about 30 mL of the above-mentioned aqueous electrolyte solution, and then about 0.3 mL of a solution obtained by diluting "Contaminon N" (manufactured by Wako Pure Chemical Industries, Ltd.; a 10% by mass aqueous neutral detergent solution with pH 7 formed of a nonionic surfactant, an anionic surfactant, and an organic builder for washing of a precision measurement apparatus) with an ion-exchanged water by three folds by mass.

(3) A prescribed amount of an ion-exchanged water is charged into a water bath of an ultrasonic disperser "Ultrasonic Dispersion System Tetoral 150" (manufactured by Nikkaki-Bios Co., Ltd.) of an electric output power of 120 W, which has, inside the apparatus, two oscillators having the oscillation frequency of 50 kHz in the sate of phase difference of 180 degrees. And then, about 2 mL of the above-mentioned Contaminon N is added into the water bath.

(4) The beaker mentioned in (2) is set in the beaker-holding hole in the above-mentioned ultrasonic disperser, and then the ultrasonic disperser is started. The height position of the beaker is adjusted so that the co-vibration of the surface of the aqueous electrolyte solution in the beaker becomes the maximum.

(5) About 10 mg of a toner is added little by little into the aqueous electrolyte solution in the beaker mentioned in (4) under dosing of the ultrasonic wave to the aqueous electrolyte solution for dispersion. The dispersion treatment by the ultrasonic wave is continued for further 60 seconds. Here, the temperature of the water in the water bath during the ultrasonic dispersion is controlled appropriately in the range from 10° C. to 40° C. (inclusive).

(6) The aqueous electrolyte solution obtained in (5) containing the dispersed toner is added dropwise with a pipette into the round bottom beaker in (1) set on the sample stand to obtain a solution with the measurement concentration of about 5%. And then the measurements are continued until the number of measured particles reaches 50,000.

(7) The measured data are analyzed by the above-mentioned dedicated software attached to the apparatus to calculate the weight-average particle diameter (D4). The "average diameter" shown in the screen analysis/volume statistics number (arithmetic mean) when the graph/volume % is set in the above-mentioned dedicated software is the weight-average particle diameter (D4).

The percentage by number of the particles having a diameter of 4 μm or less in the toner is calculated by analyzing the data after measurements by the above-mentioned Multisizer 3. Firstly, the graph/% by number is set by the above-mentioned dedicated software, and the chart of the measurement results is set at the % by number display. Then, the mark "<" in the particle diameter setting part in the screen "format/particle diameter/particle diameter statistics" is checked, and then the number "4" is entered in the particle diameter entry part thereunder. The number appearing in the display part "<4 μm", when the screen "analysis/number statistics (arithmetic mean)" is displayed, is the percentage by number of the particles having a diameter of 4.0 μm or less in the toner.

The percentage by volume of the particles having a diameter of 12.7 μm or more on a volume basis in the toner is calculated by analyzing the data after the above-mentioned Multisizer 3 measurements. Firstly, the graph/% by volume is set by the above-mentioned dedicated software, and the chart of the measurement results is set at the % by volume display. Then, the mark ">" in the particle diameter setting part in the screen "format/particle diameter/particle diameter statistics" is checked, and then the number "12.7" is entered in the particle diameter entry part thereunder. The number appearing in the display part ">12.7 μm", when the screen "analysis/volume statistics (arithmetic mean)" is displayed, is the percentage by volume of the particles having a diameter of 12.7 μm or more in the toner.

<Average Circularity of the Toner>

The average circularity of the toner is measured by a flow-type particle image analysis apparatus "FPIA-3000 Type" (manufactured by Sysmex Corp.) under the conditions of measurement and analysis used at the time of calibration. The circle equivalent diameter and the circularity are obtained by using the projected area "S" and the periphery length "L". The circle equivalent diameter is meant by the diameter of a circle having the same area as the projected area in the particle image. The circularity is defined as the value which is obtained by dividing the periphery length of the circle obtained from the circle equivalent diameter by the periphery length of the projected particle image and can be calculated by the following equation.

$$\text{Circularity } C = 2\times(\pi\times S)^{1/2}/L$$

The circularity is 1.000 when the particle image is a true circle, and is smaller when the degree of asperity in the periphery of the particle image is larger. After calculating the circularity of each particle, the range of the circularity from 0.2 to 1.0 (inclusive) is divided into 800 channels, and the median value of each channel is taken as the representative value, from which the average value is calculated to obtain the average circularity.

In the specific measurement method, after a surfactant as a dispersing agent, advantageously 0.02 g of sodium dodecylbenzene sulfonate, is added to 20 mL of ion-exchanged water, 0.02 g of a measurement sample is added. Then, the resulting mixture is treated for dispersion for 2 minutes by using a table-top ultrasonic cleaning disperser with an oscillation frequency of 50 kHz and an electric output power of 150 W (for example, "VS-150" manufactured by Velvo-Clear Co.) to obtain a disperse solution for the measurement. During the operation, the temperature of the disperse solution is cooled in the range from 10° C. to 40° C. (inclusive) appropriately.

At the measurement, the above-mentioned flow-type particle image analysis apparatus mounted with a regular objective lens (10 times magnification) is used with a sheath solution, the particle sheath "PSE-900A" (manufactured by Sysmex Corp.). The disperse solution prepared according to the above-mentioned procedure is introduced into the flow-type particle image analysis apparatus, and 3,000 toner particles are measured with the HPF measurement mode and the total count mode. The average circularity of the toner is obtained by setting the binarization threshold at the time of particle analysis at 85% while the circle equivalent diameter of the particle diameter for analysis is limited from 2.00 to 200.00 μm (inclusive).

At the measurement, adjustment of an automatic focus is made by using the standard latex particle (for example, 5200A, manufactured by Duke Scientific Corp., diluted with ion-exchanged water) prior to the measurement. Thereafter, it is advantageous to carry out the focus adjustment every two hours after start of the measurement.

In Examples of the present application, the flow-type particle image analysis apparatus with the proof certificate issued by a Sysmex Corp. was used. The measurements were made under the measurement and analysis conditions described in the proof certificate except that the circle equivalent diameter of the particle diameter for analysis was limited to the range from 2.00 to 200.00 μm (inclusive).

<A Method for Measurements of the Peak Molecular Weight (Mp), the Number-Average Molecular Weight (Mn), and the Weight-Average Molecular Weight (Mw) of the THF-Soluble Fraction of the Resin or the Toner>

The peak molecular weight (Mp), the number-average molecular weight (Mn), and the weight-average molecular weight (Mw) are measured as following by using a gel permeation chromatography (GPC). Firstly, a sample is dissolved into tetrahydrofurane (THF) at room temperature in 24 hours. The sample to be used is a resin or a toner. Thus obtained solution is filtered through "Myshori Disk" (manufactured by Tosoh Corp.), a solvent-resistant membrane filter with a pore diameter of 0.2 μm, to obtain a sample solution. Here, the sample solution is prepared so that the concentration of the THF-soluble fraction is about 0.8% by mass. By using this sample solution, measurements are made under the following conditions.

Apparatus: HLC 8120, GPC (detector: R1) (manufactured by Tosoh Corp.)

Column: a series of 7 columns of Shodex KF-801, 802, 803, 804, 805, 806, and 807 (manufactured by Showa Denko K. K.)

Eluent solution: tetrahydrofurane (THF)

Flow rate: 1.0 mL/minute

Oven temperature: 40.0° C.

Injection volume of sample: 0.10 mL

Molecular weight calculation of the sample is made with a molecular weight calibration curve obtained by using standard polystyrene resins (for example, "TSK Standard Polystyrene F-850, F-450, F-288, F-128, F-80, F-40, F-20, F-10, F-4, F-2, F-1, A-5000, A-2500, A-1000, and A-500 (trade name)" manufactured by Tosoh Corp.).

<Peak Temperature of the Maximum Endothermic Peak of the Wax, and Glass Transition Temperature Tg of the Binding Resin or the Toner>

The peak temperature of the maximum endothermic peak of the wax is measured by using a differential scanning calorimeter "Q 1000" (manufactured by TA Instruments, Inc.) in accordance with ASTM D3418-82. Temperature correction in the apparatus detector part is made with melting points of indium and zinc. Correction of the heat quantity is made with a heat of melting of indium.

Specifically, about 10 mg of wax is accurately weighed, put on a pan made of aluminum, and then measured at the heating rate of 10° C./minute in the measurement temperature range from 30 to 200° C. (inclusive) with a reference of an empty pan made of aluminum. Here, in the measurement, the temperature is raised to 200° C. once, cooled to 30° C., and then raised again. The maximum endothermic peak in the DSC curve of the second heating process in the temperature range from 30 to 200° C. (inclusive) is taken as the peak temperature of the maximum endothermic peak of the wax in the present invention. The glass transition temperature (Tg) of the binding resin or the toner is measured by using about 10 mg of an accurately weighed binding resin or toner in a similar manner to the measurement of the peak temperature of the maximum endothermic peak of the wax. Then, a change in specific heat is obtained in the temperature range from 40° C. to 100° C. (inclusive). The intersection point of the line drawn between the mid points of the base lines before and after the change in specific heat and the differential thermal curve is taken as the glass transition temperature (Tg) of the binding resin or the toner.

EXAMPLES

Production Example 1 of the Porous Magnetic Core $Fe_2O_3$: 56.1% by mass
$MnCO_3$: 35.8% by mass
$Mg(OH)_2$: 6.9% by mass
$SrCO_3$: 1.2% by mass Each of the above materials was weighed to form a ferrite raw material having the above composition.

Then, they were crushed and mixed by a dry-type ball mill using zirconia balls with 10 mm diameter (ϕ) for hours (Step 1: the weighing and mixing step). After crushing and mixing, the resulting mixture was calcined in an atmospheric air by a burner-type calcination furnace at 950° C. for 2 hours to obtain a tentatively calcined ferrite (Step 2: the tentative calcination step). The composition of the ferrite is as following:

$$(MnO)_a(MgO)_b(SrO)_c(Fe_2O_3)_d$$

wherein, a=0.395, b=0.150, c=0.010, and d=0.445.

The tentatively calcined ferrite was crushed to a size of about 0.3 mm by a crusher, and then crushed in a wet-type ball mill by using stainless steel balls with a diameter (ϕ) of 10 mm with adding 30 parts by mass of water relative to 100 parts by mass of the tentatively calcined ferrite for one hour. Thus obtained slurry was crushed in a wet-type bead mill by using zirconia beads with a diameter (ϕ) of 1.0 mm for one hour to obtain a ferrite slurry (pulverized product of tentatively calcined ferrite) (Step 3: the crushing step). Thus obtained pulverized product of tentatively calcined ferrite showed 2.0 μm as the 50% particle diameter (D50) on a volume distribution basis, 6.4 μm as the 90% particle diameter (D90) on a volume distribution basis, and 3.2 as D90/D50.

To the ferrite slurry, 2.0 parts by mass of polyvinyl alcohol relative to 100 parts by mass of the tentatively calcined ferrite was added as a binder, and then the resulting mixture was granulated to spherical particles by a spray dryer (manufactured by Okawara Corp.) (Step 4: the granulation step). In an electric furnace, the temperature was raised under the nitrogen atmosphere (1.0% by volume of oxygen concentration) from a room temperature to 1,100° C. during 3 hours and then the calcination was done at 1,100° C. for 4 hours. Thereafter, the temperature was lowered to 80° C. during 8 hours, the nitrogen atmosphere was returned to an atmospheric air, and then the particles were taken out at the temperature of 40° C. or lower (Step 5: the calcination step). After the aggregated particles were parted, they were sieved with a sieve having an opening of 250 μm for removal of coarse particles to obtain the porous magnetic core 1 with the 50% particle diameter (D50) of 29.7 μm on a volume distribution basis (Step 6: the classification step). The obtained physical properties are shown in Table 1.

Production Example 2 of the Porous Magnetic Core

In the production example 1 of the porous magnetic core, the following conditions were changed. Namely, in Step 3, the degree of crushing particles in the crusher was changed from about 0.3 mm to about 0.5 mm, the balls in the wet-type ball mill were changed from stainless steel with a 10 mm diameter (ϕ) to zirconia with a 10 mm diameter (ϕ), and the crushing time was changed from one hour to two hours. The crushing time in the wet-type bead mill was changed from one hour to two hours. In Step 5, the calcination temperature was changed from 1,100° C. to 1,050° C. and the time for raising the temperature from a room temperature to the calcination temperature was changed from 3 hours to 2 hours. The other conditions were made as same as those in the production example 1 of the porous magnetic core to obtain the porous magnetic core 2. The obtained physical properties are shown in Table 1.

Production Example 3 of the Porous Magnetic Core

In the production example 1 of the porous magnetic core, the following conditions were changed. Namely, in Step 3, the degree of crushing particles in the crusher was changed from about 0.3 mm to about 0.5 mm, the balls in the wet-type ball mill were changed from stainless steel with a 10 mm diameter (ϕ) to zirconia with a 10 mm diameter (ϕ), and the crushing time was changed from one hour to two hours. The crushing time in the wet-type bead mill was changed from one hour to three hours. In Step 4, 2.0 parts by mass of sodium carbonate was added as a pore controlling agent along with 2.0 parts by mass of polyvinyl alcohol as a binder to the ferrite slurry. In Step 5, the calcination temperature was changed from 1,100° C. to 1,050° C. The other conditions were made as same as those in the production example 1 of the porous magnetic core to obtain the porous magnetic core 3. The obtained physical properties are shown in Table 1.

Production Example 4 of the Porous Magnetic Core

In the production example 1 of the porous magnetic core, the following conditions were changed. Namely, in Step 3, the degree of crushing particles in the crusher was changed from about 0.3 mm to about 0.5 mm, the balls in the wet-type ball mill were changed from stainless steel with a 10 mm diameter (ϕ) to zirconia with a 10 mm diameter (ϕ), and the crushing time was changed from one hour to three hours. The beads in the wet-type bead mill were changed from zirconia with a 1.0 mm diameter (ϕ) to alumina with a 1.0 mm diameter (ϕ) and the crushing time was changed from one hour to two hours. In Step 4, 0.5 parts by mass of sodium carbonate was added as a pore controlling agent along with 2.0 parts by mass of polyvinyl alcohol as a binder to the ferrite slurry. In Step 5, the calcination temperature was changed from 1,100° C. to 1,050° C. and the calcination time was changed from 4 hours to 2 hours. The other conditions were made as same as those in the production example 1 of the porous magnetic core to obtain the porous magnetic core 4. The obtained physical properties are shown in Table 1.

Production Example 5 of the Porous Magnetic Core

In the production example 1 of the porous magnetic core, the following conditions were changed. Namely, in Step 1, the ratio of the ferrite raw materials was changed to the following:

$Fe_2O_3$: 61.3% by mass
$MnCO_3$: 31.0% by mass
$Mg(OH)_2$: 7.7% by mass

In Step 3, the crushing time was changed from one hour to two hours. The beads in the wet-type bead mill were changed from zirconia with a 1.0 mm diameter (ϕ) to stainless steel with a 1.0 mm diameter (ϕ) and the crushing time was changed from one hour to two hours. In Step 4, the amount of polyvinyl alcohol added as a binder was changed from 2.0 parts by mass to 1.0 parts by mass. In Step 5, the calcination temperature was changed from 1,100° C. to 1,200° C. and the calcination time was changed from 4 hours to 6 hours. The other conditions were made as same as those in the production example 1 of the porous magnetic core to obtain the porous magnetic core 5. The obtained physical properties are shown in Table 1.

Production Example 6 of the Porous Magnetic Core

In the production example 1 of the porous magnetic core, the following conditions were changed. Namely, in Step 1, the ratio of the ferrite raw materials was changed to the following:

$Fe_2O_3$: 60.7% by mass
$MnCO_3$: 32.0% by mass
$Mg(OH)_2$: 6.4% by mass
$SrCO_3$: 0.9% by mass In Step 3, the beads in the wet-type bead mill were changed from zirconia with a 1.0 mm diameter (ϕ) to stainless steel with a 1.0 mm diameter (ϕ) and the crushing time was changed from one hour to four hours. The time for raising the temperature from a room temperature to the calcination temperature was changed from 3 hours to 5 hours. The other conditions were made as same as those in the production example 1 of the porous magnetic core to obtain the porous magnetic core 6. The obtained physical properties are shown in Table 1.

Production Example 7 of the Porous Magnetic Core

In the production example 1 of the porous magnetic core, the following conditions were changed. Namely, in Step 1, the ratio of the ferrite raw materials was changed to the following:

$Fe_2O_3$: 60.8% by mass
$MnCO_3$: 24.0% by mass
$Mg(OH)_2$: 14.2% by mass
$SrCO_3$: 1.0% by mass In step 2, the temperature for the tentative calcination was changed from 950° C. to 900° C.

In Step 3, the degree of crushing particles in the crusher was changed from about 0.3 mm to about 0.5 mm, the balls in the wet-type ball mill were changed from stainless steel with a 10 mm diameter (ϕ) to alumina with a 10 mm diameter (ϕ), and the crushing time was changed from one hour to four hours. Crushing by the wet-type bead mill was not carried out. In Step 4, 4.0 parts by mass of sodium carbonate was added as a pore controlling agent along with 4.0 parts by mass of polyvinyl alcohol as a binder to the ferrite slurry. In Step 5, the calcination temperature was changed from 1,100° C. to 1,250° C. and the calcination time was changed from 4 hours to 5 hours. The other conditions were made as same as those in the production example 1 of the porous magnetic core to obtain the porous magnetic core 7. The obtained physical properties are shown in Table 1.

Production Example 8 of the Porous Magnetic Core

In the production example 1 of the porous magnetic core, the following conditions were changed. Namely, in Step 1, the ratio of the ferrite raw materials was changed to the following:

$Fe_2O_3$: 95.4% by mass
$Li_2CO_3$: 4.6% by mass

In Step 3, the crushing time in the wet-type bead mill was changed from one hour to 20 hours. In Step 5, the calcination temperature was changed from 1,100° C. to 1,150° C. The other conditions were made as same as those in the production example 1 of the porous magnetic core to obtain the porous magnetic core 8. The obtained physical properties are shown in Table 1.

Production Example 9 of the Magnetic Core $Fe_2O_3$: 73.3% by mass
CuO: 12.2% by mass
ZnO: 14.5% by mass Each of the above materials was weighed to form a ferrite raw material having the above-mentioned composition. Then, they were crushed and mixed by a dry-type ball mill using zirconia balls with 10 mm diameter (ϕ) (Step 1: the weighing and mixing step) for 2 hours. After crushing and mixing, the resulting mixture was calcined in an atmospheric air at 950° C. for 2 hours to obtain a tentatively calcined ferrite (Step 2: the tentative calcination step). After crushed to a size of about 0.5 mm by a crusher, the crushing was done in a wet-type ball mill by using stainless steel balls with a diameter (ϕ) of 10 mm with adding 30 parts by mass of water relative to 100 parts by mass of the tentatively calcined ferrite for 6 hours (Step 3: the crashing step). To the ferrite slurry, 2.0 parts by mass of polyvinyl alcohol relative to 100 parts by mass of the tentatively calcined ferrite was added as a binder, and then the resulting mixture was granulated to spherical particles by a spray dryer (manufactured by Okawara Corp.) (Step 4: the granulation step). The temperature was raised in an atmospheric air from a room temperature to the calcination temperature during 3 hours, and then the calcination was done at 1,300° C. for 4 hours. Thereafter, the temperature was lowered to 40° C. during 6 hours, and then the particles were taken out (Step 5: the calcination step). After the aggregated particles were parted, they were sieved with a sieve having an opening of 250 μm for removal of coarse particles to obtain the magnetic core 9 (Step 6: the classification step). The obtained physical properties are shown in Table 1.

Production Example 10 of the Porous Magnetic Core

In the production example 1 of the porous magnetic core, the following conditions were changed. Namely, in Step 1, the ratio of the ferrite raw materials was changed to the following:

$Fe_2O_3$: 61.8% by mass
$MnCO_3$: 31.1% by mass
$Mg(OH)_2$: 6.5% by mass
$SrCO_3$: 0.6% by mass In step 3, the beads in the wet-type bead mill was changed from the zirconia with a diameter (ϕ) of 1.0 mm to the stainless steel with a diameter (ϕ) of ⅛ inch, and the crushing was done for one hour. Then, the crushing was further done by using stainless steel beads with a diameter (ϕ) of 1/16 inch for four hours. In Step 4, the amount of polyvinyl alcohol used as a binder was changed from 2.0 parts by mass to 1.0 part by mass. In Step 5, the time for raising the temperature from a room temperature to the calcination temperature was changed from 3 hours to 5 hours, and the atmosphere was changed to nitrogen with the oxygen concentration of 0% by volume. The other conditions were made as same as those in the production example 1 of the porous magnetic core to obtain the porous magnetic core 10. The obtained physical properties are shown in Table 1.

TABLE 1

| | | Pulverized product of tentatively calcined ferrite | | | Porous magnetic core |
|---|---|---|---|---|---|
| | Composition | D50 (μm) | D90 (μm) | D90/D50 | D50 (μm) |
| Porous magnetic core 1 | $(MnO)_{0.395}(MgO)_{0.150}(SrO)_{0.010}(Fe_2O_3)_{0.445}$ | 2.0 | 6.9 | 3.2 | 29.7 |
| Porous magnetic core 2 | $(MnO)_{0.395}(MgO)_{0.150}(SrO)_{0.010}(Fe_2O_3)_{0.445}$ | 1.6 | 3.3 | 2.1 | 42.6 |
| Porous magnetic core 3 | $(MnO)_{0.395}(MgO)_{0.150}(SrO)_{0.010}(Fe_2O_3)_{0.445}$ | 1.4 | 2.2 | 1.6 | 38.5 |
| Porous magnetic core 4 | $(MnO)_{0.395}(MgO)_{0.150}(SrO)_{0.010}(Fe_2O_3)_{0.445}$ | 1.2 | 2.2 | 1.8 | 22.0 |
| Porous magnetic core 5 | $(MnO)_{0.343}(MgO)_{0.168}(Fe_2O_3)_{0.489}$ | 0.8 | 4.3 | 5.4 | 48.1 |
| Porous magnetic core 6 | $(MnO)_{0.360}(MgO)_{0.142}(SrO)_{0.008}(Fe_2O_3)_{0.491}$ | 1.5 | 1.8 | 1.2 | 31.7 |
| Porous magnetic core 7 | $(MnO)_{0.249}(MgO)_{0.290}(SrO)_{0.008}(Fe_2O_3)_{0.453}$ | 3.5 | 7.3 | 2.1 | 50.5 |
| Porous magnetic core 8 | $(Li_2O)_{0.094}(Fe_2O_3)_{0.906}$ | 0.5 | 0.6 | 1.2 | 37.2 |
| Magnetic core 9 | $(CuO)_{0.194}(ZnO)_{0.225}(Fe_2O_3)_{0.581}$ | 0.5 | 2.8 | 5.6 | 40.4 |
| Porous magnetic core 10 | $(MnO)_{0.350}(MgO)_{0.145}(SrO)_{0.005}(Fe_2O_3)_{0.500}$ | 1.4 | 1.8 | 1.3 | 34.2 |

Preparation of the Resin Solution 1

The resin solution 1 was prepared by mixing 18.0 parts by mass (as solid content) of silicone varnish (SR2411, manufactured by Dow Corning Toray Co., Ltd.), 0.5 parts by mass of γ-aminopropyl triethoxy silane, and 200.0 parts by mass of toluene for one hour.

<Preparation of the Resin Solution 2>

The resin solution 2 was prepared by mixing 100.0 parts by mass (as solid content) of silicone varnish (SR2410, manufactured by Dow Corning Toray Co., Ltd.), 10.0 parts by mass of γ-aminopropyl triethoxy silane, and 300.0 parts by mass of toluene for 2 hours.

<Preparation of the Resin Solution 3>

The resin solution 3 was prepared by mixing 22.0 parts by mass (as solid content) of styrene-methyl methacrylate copolymer (50:50 mol of the copolymer ratio, Mw=72,000), 1.0 part by mass of quaternary ammonium salt compound (P-51, manufactured by Orient Chemical Industry Co., Ltd.), and 200.0 parts by mass of toluene in a ball mill having soda glass balls with 10 mm diameter (ϕ) for one hour.

<Preparation of the Resin Solution 4>

The resin solution 4 was prepared by mixing 20.0 parts by mass (as solid content) of silicone varnish (SR2411, manufactured by Dow Corning Toray Co., Ltd.), 2.0 parts by mass of γ-aminopropyl triethoxy silane, and 1000.0 parts by mass of toluene for one hour.

<Preparation of the Resin Solution 5

The resin solution 5 was prepared by mixing 20.0 parts by mass (as solid content) of silicone varnish (SR2411, manufactured by Dow Corning Toray Co., Ltd.), 2.0 parts by mass of γ-aminopropyl triethoxy silane, 2.0 parts by mass of conductive carbon (Ketjen Black EC, manufactured by Ketjen Black International Co., Ltd.), and 1000.0 parts by mass of toluene in a ball mill having soda glass balls with 10 mm diameter (ϕ) for one hour.

Production Example 1 of the Magnetic Carrier

Step 1 (the Resin Filling Step):

Nitrogen was introduced under reduced pressure to a mixing stirrer (versatile stirrer NDMV-type, manufactured by Dalton Co., Ltd.) containing 100.0 parts by mass of the porous magnetic core 1 with keeping a temperature at 30° C., and then 13.0 parts by mass (as a resin component, relative to the porous magnetic core 1) of the resin solution 1 was added dropwise into it under reduced pressure. The agitation of the resulting mixture was continued as it was for 2 hours after completion of the dropwise addition. Thereafter, the temperature was raised to 70° C., and then the solvent was removed under reduced pressure to fill inside the core particles of the porous magnetic core 1 with the silicone resin composition. After cooling, thus obtained magnetic carrier particles were transferred to a mixer having a spiral blade inside a rotatable mixing vessel (drum mixer UD-AT type, manufactured by Sugiyama Heavy Industrial Co., Ltd.), heat-treated at 200° C. under a nitrogen atmosphere for 2 hours, and then classified by a sieve with an opening of 70 μm to obtain the magnetic core.

Step 2 (the Resin Coating Step):

This magnetic core (100.0 parts by mass) was taken into a fluidized bed coating apparatus (Spiraflow SFC type, manufactured by Freund Corp.), and then nitrogen with a charging temperature of 80° C. was charged at the flow rate of 0.8 $m^3$/minute. Rotation speed of a rotating rotor was made 1,000 rotations per minute, and after the product temperature reached 50° C., spraying of the resin solution 2 was started. The spraying rate was made at 3.5 g/minute. The coating was continued until the amount of the coated resin reached 0.8 parts by mass relative to 100.0 parts by mass of the above-mentioned magnetic core.

Thereafter, the magnetic core coated with the silicone resin was transferred to a mixer having a spiral blade inside a rotatable mixing vessel (drum mixer UD-AT type, manufactured by Sugiyama Heavy Industrial Co., Ltd.), and then heat-treated at 200° C. under a nitrogen atmosphere for 2 hours with rotating the mixing vessel at the rate of 10 rotations per minute for agitation. By agitation, the resin thickness state on surface of the magnetic carrier particles was controlled. Thus obtained magnetic carrier particles were passed through a sieve with an opening of 70 μm to obtain the magnetic carrier 1. The kind and the amount of the resin in the magnetic carrier 1 in the resin filling step and the resin coating step are shown in Table 2.

Production Examples of the Magnetic Carriers 2 to 11

The kind and the amount of the filling resin in the resin filling step, and the kind and the amount of the resin in the resin coating step were changed as shown in Table 2 to obtain the magnetic carriers 2 to 11.

Production Example of the Magnetic Carrier 12

Step 1 (the Resin Filling Step):

Into a monoaxial indirect heating dryer (Torusdisk TD type, manufactured by Hosokawa Micron Corp.) containing 100.0 parts by mass of the porous magnetic core was added dropwise 20.0 parts by mass (as a resin component, relative to the porous magnetic core 10) of the resin solution 4 while charging nitrogen and keeping a temperature at 75° C. The agitation of the resulting mixture was continued as it was for 2 hours after completion of the dropwise addition. Thereafter, the temperature was raised to 200° C., and then the solvent was removed under reduced pressure. After heating at 200° C. for hours and then cooling, the magnetic carrier 12 was obtained by classification with a sieve having an opening of 70 μm. Step 2 (the resin coating step) was not carried out.

Production Example of the Magnetic Carrier 13

In the production example of magnetic carrier 12, the filling amount in Step 1 was changed from 20.0 parts by mass to 13.0 parts by mass. Further, in Step 2, 100.0 parts by mass of the magnetic carrier 12 was taken into a fluidized bed coating apparatus (Spiraflow SFC type, manufactured by Freund Corp.), and then nitrogen with a charging temperature of 70° C. was charged at the flow rate of 0.8 $m^3$/minute. Rotation speed of a rotating rotor was made 1,000 rotations per minute, and after the product temperature reached 50° C., spraying of the resin solution 5 was started. The spraying rate was made at 3.5 g/minute. The coating was continued until the amount of the coated resin reached 2.0 parts by mass relative to 100.0 parts by mass of the magnetic carrier 12. Then, the dryer was changed to a vacuum dryer and then the heat-treatment after coating was done under reduced pressure (about 0.01 MPa) with flowing nitrogen at the rate of 0.01 $m^3$/minute at 220° C. for 2 hours to obtain the magnetic carrier 13.

Physical properties of the obtained magnetic carriers 1 to 13 are shown in Table 3.

TABLE 2

| Magnetic carrier | Core particle | Step 1 Resin type | Step 1 Amount (as resin) | Step 2 Resin type | Step 2 Amount (as resin) |
|---|---|---|---|---|---|
| Magnetic carrier 1 | Porous magnetic core 1 | Resin solution 1 | 13.0 parts by mass | Resin solution 2 | 0.8 parts by mass |
| Magnetic carrier 2 | Porous magnetic core 1 | Resin solution 1 | 13.0 parts by mass | Resin solution 3 | 0.8 parts by mass |
| Magnetic carrier 3 | Porous magnetic core 1 | Resin solution 1 | 17.0 parts by mass | Step 2 not done | |
| Magnetic carrier 4 | Porous magnetic core 2 | Resin solution 1 | 10.0 parts by mass | Step 2 not done | |
| Magnetic carrier 5 | Porous magnetic core 3 | Resin solution 1 | 20.0 parts by mass | Step 2 not done | |
| Magnetic carrier 6 | Porous magnetic core 4 | Resin solution 1 | 13.0 parts by mass | Step 2 not done | |
| Magnetic carrier 7 | Porous magnetic core 5 | Resin solution 1 | 8.0 parts by mass | Step 2 not done | |
| Magnetic carrier 8 | Porous magnetic core 6 | Resin solution 1 | 13.0 parts by mass | Resin solution 2 | 0.8 parts by mass |
| Magnetic carrier 9 | Porous magnetic core 7 | Resin solution 1 | 12.8 parts by mass | Step 2 not done | |
| Magnetic carrier 10 | Porous magnetic core 8 | Resin solution 1 | 8.0 parts by mass | Step 2 not done | |
| Magnetic carrier 11 | Magnetic core 9 | Step 1 not done | | Resin solution 2 | 1.0 parts by mass |
| Magnetic carrier 12 | Porous magnetic core 10 | Resin solution 4 | 20.0 parts by mass | Step 2 not done | |
| Magnetic carrier 13 | Porous magnetic core 10 | Resin solution 4 | 13.0 parts by mass | Resin solution 5 | 2.0 parts by mass |

TABLE 3

| Magnetic carrier | D50 (μm) | Average number A (number) | Average number B (number) | B/A (% by number) | Average number C (number) | Average number D (number) | D/C (% by number) | Area ratio of magentic core region (% by area) | Area ratio of void part region (% by area) | Ratio of particles with Rx/Ry ≦ 1.2 (%) | *Ratio (% by number) |
|---|---|---|---|---|---|---|---|---|---|---|---|
| Magnetic carrier 1 | 30.1 | 100.2 | 19.3 | 19.3 | 104.4 | 5.2 | 5.0 | 64 | 1 | 100 | 100 |
| Magnetic carrier 2 | 31.2 | 95.6 | 18.2 | 19.0 | 99.1 | 4.9 | 4.9 | 64 | 2 | 100 | 100 |
| Magnetic carrier 3 | 29.8 | 96.1 | 18.7 | 19.5 | 98.3 | 5.1 | 5.2 | 66 | 2 | 100 | 100 |
| Magnetic carrier 4 | 43.3 | 116.1 | 33.2 | 28.6 | 125.8 | 5.1 | 4.1 | 72 | 2 | 100 | 100 |
| Magnetic carrier 5 | 39.5 | 182.5 | 21.9 | 12.0 | 190.4 | 13.3 | 7.0 | 54 | 5 | 96 | 100 |
| Magnetic carrier 6 | 21.2 | 207.5 | 17.8 | 8.6 | 210.2 | 3.9 | 1.9 | 88 | 4 | 100 | 96 |
| Magnetic carrier 7 | 58.4 | 68.4 | 23.3 | 34.1 | 81.5 | 1.1 | 1.3 | 91 | 3 | 96 | 92 |
| Magnetic carrier 8 | 32.2 | 219.4 | 15.4 | 7.0 | 228.6 | 0.1 | 0.0 | 86 | 11 | 96 | 4 |
| Magnetic carrier 9 | 60.3 | 79.3 | 27.9 | 35.2 | 83.0 | 12.2 | 14.7 | 48 | 39 | 89 | 8 |
| Magnetic carrier 10 | 37.4 | 256.0 | 12.4 | 4.8 | 264.2 | 0.0 | 0.0 | 92 | 4 | 100 | 4 |
| Magnetic carrier 11 | 40.9 | 28.1 | 28.1 | 100.0 | 24.9 | 0.0 | 0.0 | 97 | 1 | 100 | 0 |
| Magnetic carrier 12 | 36.0 | 203.3 | 12.4 | 6.1 | 200.5 | 0.1 | 0.0 | 85 | 13 | 96 | 4 |
| Magnetic carrier 13 | 35.4 | 208.1 | 12.9 | 6.2 | 158.6 | 0.1 | 0.1 | 84 | 11 | 100 | 4 |

A: Average number of the magnetic core region having a length of 0.1 μm or more per magnetic carrier particle B: Average number of the magnetic core region having a length of 6.0 μm or more per magnetic carrier particle C: Average number of the region other than magnetic core part having a length of 0.1 μm or more per magnetic carrier particle D: Average number of the region other than the magnetic core part having a length of 4.0 μm or more per magnetic carrier particle

*Ratio of the magnetic carrier particles to the total magnetic carriers wherein B/A and D/C satisfy the range defined in the present invention

PRODUCTION EXAMPLES OF TONERS

Production Example of the Toner 1

Into a reaction vessel equipped with a cooling tube, an agitator, and a nitrogen inlet tube were weighed the following materials.

Terephthalic acid: 288 pars by mass

Polyoxypropylene (2.2)-2,2-bis(4-hydroxyphenyl)propane: 880 parts by mass

Titanium dihydroxybis(triethanolaminate): 1 part by mass

Thereafter, the resulting mixture was reacted by heating at 210° C. under nitrogen stream for 9 hours while removing produced water. Then, 61 parts by mass of trimellitic anhydride was added and the heating was continued at 170° C. for 3 hours to obtain the resin 1. The resin 1 had the weight-average molecular weight (Mw) of 68,000, the number-average molecular weight (Mn) of 5,700, and the peak molecular weight (Mp) of 10,500, as obtained by GPC measurement, and the glass transition temperature (Tg) of 61° C.

Then 100.0 parts by mass of the resin 1, 1.0 part by mass of the aluminum compound of di-tert-butyl salicylic acid (Bontron E88, manufactured by Orient Chemical Industry Co., Ltd.), 5.0 parts by mass of purified normal paraffin (peak temperature of 65° C. at the maximum DSC endothermic peak), and 5.5 parts by mass of C. I. Pigment Blue 15:3 were fully mixed by a Henschel mixer (FM-75 Type, manufactured by Mitsui Miike Chemical Engineering Machinery, Co., Ltd.), and then melt kneaded by a biaxial melt kneader (PCM-30 Type, manufactured by Ikegai Corp.) at 120° C. The melt kneaded product thus obtained was cooled and coarsely crushed by a hammer mill to obtain the coarsely crushed product 1. Then, thus obtained coarsely crushed product 1 was crushed further by a turbo mill T-250 (RSS rotor/SNB liner, manufactured by Turbo Kogyo Co., Ltd.) to obtain the pulverized product 1 with a size of about 5 μm.

Then, 100 parts by mass of the pulverized product 1 was mixed with 1.0 part by mass of AEROSIL R972 (manufactured by Nippon Aerosil Co., Ltd.) in a Henschel mixer (FM-75 Type, manufactured by Mitsui Miike Kakoki K. K.). Thus obtained mixture was surface-modified by a surface modifying apparatus shown in FIG. 1. The surface modification was carried out under the conditions with the charging rate of the raw materials at 2.0 kg/hour and the blowing temperature of the heated air at 210° C. Then, fine particles and coarse particles were removed simultaneously by an air wind classifier using Coanda effect (Elbojet Labo EJ-L3, manufactured by Nittetsu Mining Co., Ltd.) to obtain the toner particles 1. Thus obtained toner particles 1 (100.0 parts by mass) were mixed with external additives, 1.0 part by mass of STT-30A (manufactured by Titan Kogyo, Ltd.) and 1.0 part by mass of AEROSIL R972 (Nippon Aerosil Co., Ltd.) to obtain the toner 1. Properties of the toner 1 were as following; 6.2 μm as the weight-average particle diameter (D4), 21.3% by number of the particles having a diameter of 4.0 μm or less on a number basis, 1.0% by volume of the particles having a diameter of 12.7 μm or more on a volume basis, and 0.969 as the average circularity.

Production Example of the Toner 2

In the production example of toner 1, the obtained pulverized product 1 was treated by a particle design apparatus (product name of FACULTY, manufactured by Hosokawa Micron Corp.), which was modified in shape and number of the hammer, for simultaneous classification and spheronization to obtain the toner particles 2. Other than the above-mentioned, the same operation as the production example of the toner 1 was followed to obtain the toner 2. Properties of the toner 2 were as following; 5.5 μm as the weight-average particle diameter (D4), 27.6% by number of the particles having a diameter of 4.0 μm or less on a number basis, 0.4% by volume of the particles having a diameter of 12.7 μm or more on a volume basis, and 0.950 as the average circularity.

Production Example of the Toner 3

Styrene monomer (100.0 parts by mass), 16.5 parts by mass of C.I. Pigment Blue 15:3, and 3.0 parts by mass of the aluminum compound of di-tert-butyl salicylic acid (Bontron E88, manufactured by Orient Chemical Industry Co., Ltd.) were charged into Attritor (manufactured by Mitsui Mining Co., Ltd.), and then the resulting mixture was agitated at 3.3 $s^{-1}$ (200 rpm) by using 140 parts by mass of zirconia beads having 1.25 mm diameter (ϕ) at 25° C. for 180 minutes to obtain the master batch disperse solution 1.

Separately, 900 parts by mass of 0.1 M $Na_3PO_4$ aqueous solution was added to 710 parts by mass of ion-exchanged water. After the resulting mixture was heated to 60° C., 67.7 parts by mass of 1.0 M $CaCl_2$ aqueous solution was gradually added into the mixture to obtain an aqueous medium containing a calcium phosphate compound.

Then, a mixture of 40.0 parts by mass of the master batch disperse solution 1, 67.0 parts by mass of styrene monomer, 19.0 parts by mass of n-Butyl acrylate monomer, 12.0 parts by mass of ester wax (endothermic peak temperature of 66° C.), 0.2 parts by mass of divinyl benzene, and 5.0 parts by mass of saturated polyester (polycondensation product of bisphenol A propyleneoxide adduct, terephthalic acid, and trimellitic anhydride; Mp=11,000) was heated to 55° C., and dissolved and dispersed homogeneously by a TK-type homomixer (manufactured by Tokushu Kika Kogyo Co., Ltd.) at 83.3 $S^{-1}$ (5,000 rpm). Into this mixture was dissolved 3.5 parts by mass of 2,2'-azobis(2,4-dimethylvaleronitrile) (a polymerization initiator) to obtain a monomer composition. The monomer composition was charged into the above-mentioned aqueous medium and the resulting mixture was agitated in the TK-type homomixer at 233.3 $s^{-1}$ (14,000 rpm) and 60° C. under a nitrogen atmosphere to granulate the monomer composition.

Thereafter, the composition was agitated with a paddle agitator for 5 hours. After the temperature was raised to 80° C. at the heating rate of 40° C./hour, the reaction was carried out for 5 hours with agitation. After termination of the polymerization, residual monomers were removed by evaporation under reduced pressure. After cooled, hydrochloric acid was added to adjust the pH at 1.4, and then the calcium phosphate salt was dissolved by agitating the resulting mixture for 6 hours. Thereafter, the mixture was filtered, washed by ion-exchanged water, and then dried to obtain the toner particles 3.

Other than the above-mentioned, the same operation as the production example of the toner 1 was followed to obtain the toner 3 having the following properties; 4.5 μm as the weight-average particle diameter (D4), 33.1% by number of the particles having a diameter of 4.0 μm or less on a number basis, 0.0% by volume of the particles having a diameter of 12.7 μm or more on a volume basis, and 0.991 as the average circularity. Molecular weights of the THF-soluble fraction of the toner 3 obtained by GPC were as following; 40,000 as the weight-average molecular weight (Mw), 11,500 as the number-average molecular weight (Mn), and 28,000 as the peak molecular weight (Mp).

Production Example of the Toner 4

In the production example of the toner 1, the obtained pulverized product 1 was classified by an air wind classifier Elbojet (manufactured by Nittetsu Mining Co., Ltd.) to obtain the toner particles 4. Properties of the toner particles 4 were as following; 5.1 μm as the weight-average particle diameter (D4), 34.8% by number of the particles having a diameter of 4.0 μm or less on a number basis, 0.6% by volume of the particles having a diameter of 12.7 μm or more on a volume basis, and 0.939 as the average circularity. Other than the above-mentioned, the same operation as the production example of the toner 1 was followed to obtain the toner 4.

Production Example of the Toner 5

In the production example of the toner 1, the obtained coarsely crushed product 1 was made to the pulverized product 2 by using a collision-type air jet pulverizing mill with a high pressure air. Thus obtained pulverized product 2 was classified by an air wind classifier Elbojet (manufactured by Nittetsu Mining Co., Ltd.) to obtain the toner particles 5. Properties of the toner particles 5 were as following; 8.9 μm as the weight-average particle diameter (D4), 11.7% by number of the particles having a diameter of 4.0 μm or less on a number basis, 5.2% by volume of the particles having a diameter of 12.7 μm or more on a volume basis, and 0.932 as the average circularity. Other than the above-mentioned, the same operation as the production example of the toner 1 was followed to obtain the toner 5.

The physical properties of the toners 1 to 5 are shown in Table 4.

TABLE 4

| Toner | D4 (μm) | Particles having a diameter of 4.0 μm or less (% by number) | Particles having a diameter of 12.7 μm or more (% by volume) | Average circularity |
|---|---|---|---|---|
| Toner 1 | 6.2 | 21.3 | 1.0 | 0.969 |
| Toner 2 | 5.5 | 27.6 | 0.4 | 0.950 |
| Toner 3 | 4.5 | 33.1 | 0.0 | 0.991 |
| Toner 4 | 5.1 | 34.8 | 0.6 | 0.939 |
| Toner 5 | 8.9 | 11.7 | 5.2 | 0.932 |

Examples 1 to 7 and Comparative Examples 1 to 8

The prepared magnetic carrier and toner were combined as shown in Table 5 to obtain the two component developer. The two component developer was made by mixing them by a V-shape mixer for 5 minutes in the ratio of 90.0% by mass of the magnetic carrier and 10.0% by mass of the toner. Thus obtained two component developer was evaluated by the following methods, and the results are shown in Table 6.

TABLE 5

| | Magnetic carrier | Toner |
|---|---|---|
| Ex. 1 | Magnetic carrier 1 | Toner 1 |
| Ex. 2 | Magnetic carrier 2 | Toner 1 |
| Ex. 3 | Magnetic carrier 3 | Toner 1 |
| Ex. 4 | Magnetic carrier 4 | Toner 2 |
| Ex. 5 | Magnetic carrier 5 | Toner 2 |
| Ex. 6 | Magnetic carrier 6 | Toner 2 |
| Ex. 7 | Magnetic carrier 7 | Toner 3 |
| Com. Ex. 1 | Magnetic carrier 8 | Toner 1 |
| Com. Ex. 2 | Magnetic carrier 8 | Toner 4 |
| Com. Ex. 3 | Magnetic carrier 8 | Toner 5 |
| Com. Ex. 4 | Magnetic carrier 9 | Toner 1 |
| Com. Ex. 5 | Magnetic carrier 10 | Toner 1 |

TABLE 5-continued

| | Magnetic carrier | Toner |
|---|---|---|
| Com. Ex. 6 | Magnetic carrier 11 | Toner 1 |
| Com. Ex. 7 | Magnetic carrier 12 | Toner 1 |
| Com. Ex. 8 | Magnetic carrier 13 | Toner 1 |

To use as the image forming apparatus, a commercially used digital printer imagePRESS C1 (manufactured by Canon, Inc.) was modified, and using this, the image was formed for evaluation by charging the above-mentioned developer into the cyan position of the development unit. Here, the modification was made so that the mechanism that would discharge an excessive magnetic carrier in the development unit from the development unit was removed and an alternate current voltage with 2.0 kHz frequency and 1.3 kV Vpp and a direct current voltage $V_{DC}$ were applied to the developer carrier. The direct current voltage $V_{cc}$ was controlled so that the mounting amount of the toner of the FFh image (solid image) on a sheet of paper would be 0.6 mg/cm$^2$. Here, the FFh image is the value showing the 256 gradations by the hexadecimal, wherein the first gradation of 256 gradations (white part) is taken as 00h and the 256th gradation of 256 gradations (solid part) is taken as FFh. Under the above-mentioned conditions, the 50,000 copies durability test with the image ratio of 5% was carried out by using the original script (A4) of the FFh image to evaluate the following items.

Printing Environment:

Normal temperature/normal humidity: 23° C./60% relative humidity (hereinafter referred to as N/N)

High temperature/high humidity: 30° C./80% relative humidity (hereinafter referred to as H/H)

Paper: CS-814 (paper for laser beam printer (81.4 g/m$^2$), available from Canon Marketing Japan, Inc.)

<Dot Reproducibility>

A dot image (FFh image) formed with one pixel by one dot was prepared. The spot diameter of a laser beam was adjusted so that the area per dot on a sheet of paper would be from 20,000 μm$^2$ to 25,000 μm$^2$ (inclusive). The area of 1,000 dots was measured by using a digital microscope VHX-500 (wide range zoom lens VH-Z100, manufactured by Keyence Corp.). The number-average of the dot area (S) and the standard deviation of the dot area (G) were calculated and the dot reproducibility index was calculated by the following equation.

$$\text{Dot reproducibility index } (I) = \sigma/S \times 100$$

Wherein,

A: I is less than 4.0

B: I is 4.0 or more and less than 6.0

C: I is 6.0 or more and less than 8.0

D: I is 8.0 or more

<Fogging>

At N/N and H/H, 10 sheets of paper of the 00h image were printed out, and the average reflectance Dr (%) of the 10th copy was measured by a reflectometer (Reflectomer Model TC-6DS, manufactured by Tokyo Denshoku Co., Ltd.). On the other hand, the reflectance Ds (%) of the paper without image output was measured. The fog (%) was calculated by the following equation.

$$\text{Fog } (\%) = Dr(\%) - Ds(\%)$$

Wherein,

A: less than 0.5%

B: 0.5% or more and less than 1.0%

C, 1.0% or more and less than 2.0%

D: 2.0% or more

<Image Uniformity (Density Variation)>

The 90h image was printed out on the entire area of three A3 sheets of paper. The evaluation of the image was made on the third copy. For evaluation of the image uniformity, the image densities at five locations were measured and the difference between the maximum and the minimum was measured. The image density was measured by an X-Rite color reflection densitometer (color reflection densitometer X-Rite 404A).

A: less than 0.04
B: 0.04 or more and less than 0.08
C: 0.08 or more and less than 0.12
D: 0.12 or more <Change of the Image Density by Allowing to Stand after the Durability Test>

After the durability test at N/N and H/H, the FFh image (5 cm×5 cm) was printed out on 3 sheets of paper, and the image density of the third copy was measured. The main body of the evaluation apparatus was allowed to stand in each environmental condition for 3 days, and then the FFh image (5 cm×5 cm) was printed out on one paper to measure the image density for evaluation of the density difference before and after allowing to stand. The density was measured by the above-mentioned color reflection densitometer X-Rite.

A: 0.00 or more and less than 0.05
B: 0.05 or more and less than 0.10
C: 0.10 or more and less than 0.20
D: 0.20 or more <Carrier Adhesion>

The carrier adhesion before and after the durability test at N/N was evaluated. The 00h image was printed and a transparent adhesive tape was contacted on the electrostatic image carrier (photoconductor drum) for sampling. The number of magnetic carrier particles adhered on the electrostatic image carrier (the area of 1 cm×1 cm) was counted to calculate the number of adhered carrier particles per $cm^2$.

A: 3 or less
B: from 4 to 10 (inclusive)
C: from 11 to 20 (inclusive)
D: 21 or more

TABLE 6

| | N/N | | | | | | | | H/H |
|---|---|---|---|---|---|---|---|---|---|
| | Carrier adhesion | | Dot reproducibility | | Fogging | | Image uniformity | | Density change (before |
| | Initial | After durability test | Initial | After durability test | Initial | After durability test | Initial | After durability test | and after allowing to stand) |
| Ex. 1 | A(0) | A(1) | A(0.8) | A(1.0) | A(0.0) | A(0.1) | A(0.00) | A(0.01) | A(0.00) |
| Ex. 2 | A(0) | A(0) | A(0.8) | A(1.1) | A(0.0) | A(0.1) | A(0.00) | A(0.01) | A(0.00) |
| Ex. 3 | A(0) | A(2) | A(1.0) | A(1.4) | A(0.0) | A(0.1) | A(0.01) | A(0.02) | A(0.01) |
| Ex. 4 | A(1) | A(2) | A(1.5) | A(2.0) | A(0.0) | A(0.1) | A(0.02) | A(0.03) | A(0.01) |
| Ex. 5 | A(2) | B(6) | A(1.7) | A(2.2) | A(0.2) | A(0.3) | A(0.03) | B(0.05) | A(0.03) |
| Ex. 6 | B(4) | B(7) | A(2.4) | A(3.6) | A(0.1) | A(0.3) | A(0.02) | A(0.03) | A(0.03) |
| Ex. 7 | A(0) | A(2) | A(3.3) | B(4.9) | A(0.3) | B(0.5) | A(0.02) | B(0.06) | A(0.04) |
| Com. Ex. 1 | A(2) | D(22) | A(3.1) | C(6.0) | A(0.2) | B(0.5) | A(0.03) | B(0.07) | A(0.03) |
| Com. Ex. 2 | A(1) | D(24) | B(4.4) | C(7.1) | A(0.3) | C(1.2) | B(0.04) | B(0.07) | B(0.08) |
| Com. Ex. 3 | A(2) | D(26) | B(5.6) | D(8.3) | B(0.6) | C(1.4) | B(0.06) | C(0.11) | B(0.09) |
| Com. Ex. 4 | B(5) | D(30) | B(5.5) | D(10.8) | A(0.3) | D(3.9) | B(0.06) | D(0.13) | C(0.19) |
| Com. Ex. 5 | A(3) | C(16) | B(4.8) | C(7.5) | A(0.2) | C(1.4) | A(0.03) | C(0.08) | B(0.12) |
| Com. Ex. 6 | A(1) | B(6) | B(4.6) | D(13.3) | A(0.3) | C(1.7) | A(0.02) | D(0.12) | B(0.07) |
| Com. Ex. 7 | A(0) | B(6) | A(3.0) | C(6.0) | A(0.3) | B(0.9) | C(0.11) | D(0.13) | B(0.09) |
| Com. Ex. 8 | B(4) | D(24) | B(4.0) | C(7.3) | B(0.7) | D(3.0) | B(0.04) | B(0.07) | D(0.20) |

| | H/H | | | | | | |
|---|---|---|---|---|---|---|---|
| | Dot reproducibility | | Fogging | | Image uniformity | | Density change (before |
| | Initial | After durability test | Initial | After durability test | Initial | After durability test | and after allowing to stand) |
| Ex. 1 | A(1.8) | A(2.6) | A(0.1) | A(0.2) | A(0.00) | A(0.02) | A(0.01) |
| Ex. 2 | A(2.0) | A(2.9) | A(0.1) | A(0.3) | A(0.01) | A(0.01) | A(0.02) |
| Ex. 3 | A(2.1) | A(3.2) | A(0.2) | A(0.3) | A(0.02) | A(0.03) | B(0.05) |
| Ex. 4 | A(2.6) | A(3.4) | A(0.2) | A(0.3) | A(0.02) | B(0.04) | B(0.05) |
| Ex. 5 | A(2.6) | A(3.5) | A(0.2) | A(0.4) | A(0.03) | B(0.06) | B(0.08) |
| Ex. 6 | B(4.0) | B(5.2) | A(0.2) | B(0.5) | B(0.04) | B(0.07) | B(0.07) |
| Ex. 7 | A(3.8) | B(5.9) | A(0.4) | B(0.7) | A(0.03) | C(0.08) | C(0.10) |
| Com. Ex. 1 | B(3.6) | D(8.2) | A(0.4) | C(1.1) | A(0.03) | C(0.10) | B(0.08) |

TABLE 6-continued

| | | | | | | | |
|---|---|---|---|---|---|---|---|
| Com. Ex. 2 | B(5.3) | D(8.9) | B(0.5) | D(2.1) | B(0.05) | C(0.11) | C(0.11) |
| Com. Ex. 3 | C(7.1) | D(11.5) | C(1.0) | D(2.4) | B(0.07) | D(0.14) | C(0.14) |
| Com. Ex. 4 | C(7.2) | D(15.3) | B(0.8) | D(5.4) | B(0.07) | D(0.16) | D(0.31) |
| Com. Ex. 5 | B(5.7) | D(10.1) | B(0.5) | D(2.1) | B(0.05) | D(0.12) | D(0.28) |
| Com. Ex. 6 | C(7.5) | D(14.7) | B(0.8) | D(2.3) | B(0.06) | D(0.14) | C(0.18) |
| Com. Ex. 7 | B(4.0) | C(7.1) | B(0.5) | C(1.2) | C(0.11) | D(0.16) | C(0.10) |
| Com. Ex. 8 | C(7.0) | D(16.3) | C(1.0) | D(6.3) | B(0.07) | D(0.13) | D(0.36) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-200644, filed Aug. 4, 2008, which is hereby incorporated by reference herein in its entirety.

What is claimed is:

1. A magnetic carrier having magnetic carrier particles produced by filling pores of porous magnetic core particles with a resin, wherein the magnetic carrier contains 80% by number or more of the magnetic carrier particles satisfying the following (a) and (b) when 18 straight lines passing through a reference point of a cross section of the magnetic carrier particle are drawn at intervals of 10° in a reflected electron image of the cross section of the magnetic carrier particle photographed by a scanning electron microscope:

(a) the number of magnetic core regions having a length of 6.0 μm or longer on the straight lines is from 5.0% by number or more to 35.0% by number or less relative to the number of magnetic core regions having a length of 0.1 μm or longer on the straight lines, and (b) the number of regions other than the magnetic core part having a length of 4.0 μm or longer on the straight lines is from 1.0% by number or more to 15.0% by number or less relative to the number of regions other than the magnetic core part having a length of 0.1 μm or longer on the straight lines.

2. The magnetic carrier according to claim 1, wherein the ratio of the area of the magnetic core region to the area of the cross section of the magnetic carrier particle is from 50% by area or more to 90% by area or less in the reflected electron image of the cross section of the magnetic carrier particle photographed by the scanning electron microscope.

3. The magnetic carrier according to claim 1, wherein the magnetic carrier particles are particles where a surface of the particles produced by filling pores of porous magnetic core particles with a resin is further coated with a resin.

4. A two component developer comprising at least a magnetic carrier and a toner, wherein the magnetic carrier is a magnetic carrier according to claim 1.

5. The two component developer according to claim 4, wherein in the toner, the content of the particle having a diameter of 4.0 μm or less on a number basis is 35.0% by number or less and the content of the particle having a diameter of 12.7 μm or more on a volume basis is 3.0% by volume or less.

* * * * *